US006401062B1

(12) United States Patent
Murashima

(10) Patent No.: US 6,401,062 B1
(45) Date of Patent: Jun. 4, 2002

(54) APPARATUS FOR ENCODING AND APPARATUS FOR DECODING SPEECH AND MUSICAL SIGNALS

(75) Inventor: Atsushi Murashima, Tokyo (JP)

(73) Assignee: Nec Corporation, Tokyo (JP)

( * ) Notice: Subject to any disclaimer, the term of this patent is extended or adjusted under 35 U.S.C. 154(b) by 0 days.

(21) Appl. No.: 09/258,900

(22) Filed: Mar. 1, 1999

(30) Foreign Application Priority Data

Feb. 27, 1998 (JP) ..... 10-064721

(51) Int. Cl.[7] ..... G10L 11/00

(52) U.S. Cl. ..... 704/223; 704/219; 704/220

(58) Field of Search ..... 704/262, 223, 704/219, 220, 229, 230, 501

(56) References Cited

U.S. PATENT DOCUMENTS

| | | | | | |
|---|---|---|---|---|---|
| 4,736,428 | A | * | 4/1988 | Deprettere et al. | 704/264 |
| 4,932,061 | A | * | 6/1990 | Kroon et al. | 704/223 |
| 4,944,013 | A | * | 7/1990 | Gouvianakis et al. | 704/219 |
| 5,193,140 | A | * | 3/1993 | Minde | 704/222 |
| 5,701,392 | A | * | 12/1997 | Adoul et al. | 704/219 |
| 5,778,335 | A | * | 7/1998 | Ubale et al. | 704/219 |
| 5,819,212 | A | * | 10/1998 | Matsumoto et al. | 704/219 |
| 5,886,276 | A | * | 3/1999 | Levine et al. | 704/220 |
| 5,937,376 | A | * | 8/1999 | Minde | 704/219 |
| 5,970,444 | A | * | 10/1999 | Hayashi et al. | 704/223 |
| 5,991,717 | A | * | 11/1999 | Minde et al. | 704/223 |
| 6,023,672 | A | * | 2/2000 | Ozawa | 704/222 |

FOREIGN PATENT DOCUMENTS

| | | | |
|---|---|---|---|
| EP | 396 121 | 11/1990 | |
| JP | 9-46233 | 2/1997 | G10L/21/00 |

OTHER PUBLICATIONS

Schroeder, M., et al., "Code Excited Linear Prediction (CELP): High–Quality Speech at Very Low Bit Rates," IEEE Proc. of ICASSP, pp. 937–940 (1985).

Sasaki, S., et al., "Improved CELP Coding for Audio Signal," Acoustical Soc. of Japan, Meeting for Reading Research Papers, Collected Papers, pp. 263–264 (1996).

Serizawa, M., et al., "A 16 KBIT/S Wideband CELP Coder with a High–Order Backward Predictor and its Fast Coefficient Calculation," IEEE Workshop on Speech Coding for Telecommunications, pp. 107–108 (1997).

Ozawa, K., et al., "MP–CELP Speech Coding Based on Multi–Pulse Vector Quantization and Fast Search," Denshi Joho Tsushin Gakkai Ronbunshi A, vol. J79–A, No. 10, pp. 1655–1663 (1996).

Ubale, A., et al., "Multi–Band CELP Coding of Speech and Music," IEEE Workshop on Speech Coding for Telecommunications, pp. 101–102 (1997).

Sugamura, N., et al., "Speech Data Compression by LSP Speech Analysis–Synthesis Techniques," Denshi Joho Tsushin Gakkai Ronbunshi A, vol. J64–A, No. 8, pp. 599–606 (1981).

(List continued on next page.)

*Primary Examiner*—Richemond Dorvil
*Assistant Examiner*—Daniel Abebe
(74) *Attorney, Agent, or Firm*—Foley & Lardner

(57) ABSTRACT

A speech and musical signal codec employing a band splitting technique encodes sound source signals of each of a plurality of bands using a small number of bits. The codec includes a second pulse position generating circuit, to which an index output by a minimizing circuit and a first pulse position vector $P^{-}=(P_1, P_2, \ldots, P_M)$ are input, for revising the first pulse position vector using a pulse position revision quantity $d^{-}_{i}=(d_{i1}, d_{i2}, \ldots, d_{iM})$ specified by the index and outputting the revised vector to a second sound source generating circuit as a second pulse position vector $P^{-i}=(P_1+d_{i1}, P_2+d_{i2}, \ldots, P_M+d_{iM})$.

16 Claims, 12 Drawing Sheets

OTHER PUBLICATIONS

Ohmuro, H., et al., "Vector Quantization of LSP Parameters Using Moving Average Interframe Prediction," Denshi Joho Tsushin Gakkai Ronbunshi A, vol. J77–A, No. 3, pp. 303–313 (1994).

X. Lin et al., "Subband–multipulse digital audio broadcasting for mobile receivers", IEEE Transactions on Broadcasting, vol. 39, No. 4, Dec. 1, 1993, pp. 373–382.

K. Ozawa et al., "MP–CELP Speech Coding Based on Multipulse Vector Quantization and Fast Search", Electronics & Communications Japan, Part III—Fundamental Electronic Sci. vol. 80:11, 11/97, pp. 55–63.

A. Ubale et al., "Multi–band Celp Coding of Speech and Music", IEEE Workshop on Speech Coding for Tele. Back to Basics Attacking Fundamental Problems in Speech Coding, 1997, pp. 101–102.

* cited by examiner

APPARATUS FOR ENCODING AND APPARATUS FOR DECODING SPEECH AND MUSICAL SIGNALS

FIELD OF THE INVENTION

This invention relates to an apparatus for encoding and an apparatus for decoding speech and musical signals. More particularly, the invention relates to a coding apparatus and a decoding apparatus for transmitting speech and musical signals at a low bit rate.

BACKGROUND OF THE INVENTION

A method of encoding a speech signal by separating the speech signal into a linear prediction filter and its driving sound source signal is used widely as a method of encoding a speech signal efficiently at medium to low bit rates.

One such method that is typical is CELP (Code-Excited Linear Prediction). With CELP, a linear prediction filter for which linear prediction coefficients obtained by subjecting input speech to linear prediction analysis have been decided is driven by a sound source signal represented by the sum of a signal that represents the speech pitch period and a noise signal, whereby there is obtained a synthesized speech signal (i.e., a reconstructed signal). For a discussion of CELP, see the paper (referred to as "Reference 1") "Code excited linear prediction: High quality speech at very low bit rates" by M. Schroeder et. al (Proc. ICASSP, pp. 937–940, 1985).

A method using a higher-order linear prediction filter representing the complicated spectrum of music is known as a method of improving music encoding performance by CELP. According to this method, the coefficients of a higher-order linear prediction filter are found by applying linear prediction analysis at a high order of from 50 to 100 to a signal obtained by inverse filtering a past reconstructed signal using a linear prediction filter. A signal obtained by inputting a musical signal to the higher-order linear prediction filter is applied to a linear prediction filter to obtain the reconstructed signal.

As an example of an apparatus for encoding speech and musical signals using a higher-order prediction linear filter, see the paper (referred to as "Reference 2") "Improving the Quality of Musical Signals in CELP Coding", by Sasaki et al. (Acoustical Society of Japan, Spring, 1996 Meeting for Reading Research Papers, Collected Papers, pp. 263–264, 1996) and the paper (referred to as "Reference 3") "A 16 Kbit/s Wideband CELP Coder with a High-Order Backward Predictor and its Fast Coefficient Calculation" by M Serizawa et al. (IEEE Workshop on Speech Coding for Telecommunications, pp. 107–108, 1997).

A known method of encoding a sound source signal in CELP involves expressing a sound source signal efficiently by a multi pulse signal comprising a plurality of pulses and defined by the positions of the pulses and pulse amplitudes.

For a discussion of encoding of a sound source signal using a multipulse signal, see the paper (referred to as "Reference 4") "MP-CELP Speech Coding based on Multi-Pulse Vector Quantization and Fast Search" by Ozawa et al. (Transaction A, Institute of Electronics, Information and Communication Engineers of Japan (Trans. IEICEJ), pp. 1655–1663, 1996). Further, by adopting a band splitting arrangement using a sound source signal found for each band and a higher-order backward linear prediction filter in an apparatus for encoding speech and musical signals based upon CELP, the ability to encode music is improved.

With regard to CELP using band splitting, see the paper (referred to as "Reference 5") "Multi-band CELP Coding of Speech and Music" by A. Ubale et al. (IEEE Workshop on Speech Coding for Telecommunications, pp. 101–102, 1997).

FIG. 10 is a block diagram showing an example of the construction of an apparatus for encoding speech and music according to the prior art. For the sake of simplicity, it is assumed here that the number of bands is two.

As shown in FIG. 10, an input signal (input vector) enters from an input terminal 10. The input signal is generated by sampling a speech or musical signal and gathering a plurality of the samples into a single vector as one frame.

A first linear prediction coefficient calculation circuit 140 receives the input vector as an input from the input terminal 10. This circuit subjects the input vector to linear prediction analysis, obtains a linear prediction coefficient and quantizes the coefficient. The first linear prediction coefficient calculation circuit 140 outputs the linear prediction coefficient to a weighting filter 160 and outputs an index, which corresponds to a quantized value of the linear prediction coefficient, to a linear prediction filter 150 and to a code output circuit 690.

A known method of quantizing a linear prediction coefficient involves converting the coefficient to a line spectrum pair (referred to as an "LSP") to effect quantization. For a discussion of the conversion of a linear prediction coefficient to an LSP, see the paper (referred to as "Reference 6") "Speech Data Compression by LSP Speech Analysis-Synthesis Technique" by Sugamura et al. (Transaction A, Institute of Electronics, Information and Communication Engineers of Japan (Trans. IEICEJ), Vol. J64-A, No. 8, pp. 599–606, 1981). In regard to quantization of an LSP, see the paper (referred to as "Reference 7") "Vector Quantization of LSP Parameters Using Moving Average Interframe Prediction" by Omuro et al. (Transaction A, Institute of Electronics, Information and Communication Engineers of Japan (Trans. IEICEJ), Vol. J77-A, No. 3, pp. 303–312, 1994).

A first pulse position generating circuit 610 receives as an input an index that is output by a minimizing circuit 670, generates a first pulse position vector using the position of each pulse specified by the index and outputs this vector to a first sound source generating circuit 20.

Let M represent the number of pulses and let P1, P2, . . . , PM represent the positions of the pulses. The vector P, therefore, is written as follows:

$=(\bar{P}\mathbf{1}, P\mathbf{2}, \ldots, P_M)$ (It should be noted that the bar over P indicates that P is a vector.)

A first pulse amplitude generating circuit 120 has a table in which M-dimensional vectors $\bar{A}_j$, j=1, . . . , NA have been stored, where NA represents the size of the table. The index output by the minimizing circuit 670 enters the first pulse amplitude generating circuit 120, which proceeds to read an M-dimensional vector $\bar{A}_i$ corresponding to this index out of the above-mentioned table and outputs this vector to the first sound source generating circuit 20 as a first pulse amplitude vector.

Letting $A_{i1}, A_{i2}, \ldots, A_{iM}$ represent the amplitude values of the pulses, we have $\bar{A}_i=(A_{i1}, A_{i2}, \ldots, A_{iM})$ A second pulse position generating circuit 611 receives as an input the index that is output by the minimizing circuit 670, generates a second pulse position vector using the position of each pulse specified by the index and outputs this vector to a second sound source generating circuit 21.

A second pulse amplitude generating circuit 121 has a table in which M-dimensional vectors $B^-_j$, j=1, . . . , $N_B$ have been stored, where $N_B$ represents the size of the table.

The index output by the minimizing circuit 670 enters the second pulse amplitude generating circuit 121, which proceeds to read an M-dimensional vector $B^-_j$ corresponding to this index out of the above-mentioned table and outputs this vector to the second sound source generating circuit 21 as a second pulse amplitude vector.

The first pulse position vector $P^-=(P_1, P_2, P_M)$ output by the first pulse position generating circuit 610 and the first pulse amplitude vector $A^-_i=(A_{i1}, A_{i2}, \ldots, A_{iM})$ output by the first pulse amplitude generating circuit 120 enter the first sound source generating circuit 20. The first sound source generating circuit 20 outputs an N-dimensional vector for which the values of the $P_1$st, $P_2$nd, . . . , $P_M$th elements are $A_{i1}, A_{i2}, \ldots, A_{iM}$, respectively, and the values of the other elements are zero to a first gain circuit 30 as a first sound source signal (sound source vector).

A second pulse position vector $Q^-=(Q_1, Q_2, \ldots, Q_M)$ output by the second pulse position generating circuit 611 and a second pulse amplitude vector $B^-=(B_{i1}, B_{i2}, \ldots, B_{iM})$ output by the second pulse amplitude generating circuit 121 enter the second sound source generating circuit 21. The second sound source generating circuit 21 outputs an N-dimensional vector for which the values of the $Q_1$st, $Q_2$nd, . . . , $Q_M$th elements are $B_{i1}, B_{i2}, \ldots, B_{iM}$, respectively, and the values of the other elements are zero to a second gain circuit 31 as a second sound source signal.

The first gain circuit 30 has a table in which gain values have been stored. The index output by the minimizing circuit 670 and the first sound source vector output by the first sound source generating circuit 20 enter the first gain circuit 30, which proceeds to read a first gain corresponding to the index out of the table, multiply the first gain by the first sound source vector to thereby generate a third sound source vector, and output the generated third sound source vector to a first higher-order linear prediction filter 130.

The second gain circuit 31 has a table in which gain values have been stored. The index output by the minimizing circuit 670 and the second sound source vector output by the second sound source generating circuit 21 enter the second gain circuit 31, which proceeds to read a second gain corresponding to the index out of the table, multiply the second gain by the second sound source vector to thereby generate a fourth sound source vector, and output the generated fourth sound source vector to a second higher-order linear prediction filter 131.

A third higher-order linear prediction coefficient output by a higher-order linear prediction coefficient calculation circuit 180 and a third sound source vector output by the first gain circuit 30 enter the first higher-order linear prediction filter 130. The filter thus set to the third higher-order linear prediction coefficient is driven by the third sound source vector, whereby a first excitation vector is obtained. The first excitation vector is output to a first band-pass filter 135.

A fourth higher-order linear prediction coefficient output by the higher-order linear prediction coefficient calculation circuit 180 and a fourth sound source vector output by the second gain circuit 31 enter the second higher-order linear prediction filter 131. The filter thus set to the fourth higher-order linear prediction coefficient is driven by the fourth sound source vector, whereby a second excitation vector is obtained. The second excitation vector is output to a second band-pass filter 136.

The first excitation vector output by the first higher-order linear prediction filter 130 enters the first band-pass filter 135. The first excitation vector has its band limited by the filter 135, whereby a third excitation vector is obtained. The first band-pass filter 135 outputs the third excitation vector to an adder 40.

The second excitation vector output by the second higher-order linear prediction filter 131 enters the second band-pass filter 136. The second excitation vector has its band limited by the filter 136, whereby a fourth excitation vector is obtained. The fourth excitation vector is output to the adder 40.

The adder 40 adds the inputs applied thereto, namely the third excitation vector output by the first band-pass filter 135 and the fourth excitation vector output by the second band-pass filter 136, and outputs a fifth excitation vector, which is the sum of the third and fourth excitation vectors, to the linear prediction filter 150.

The linear prediction filter 150 has a table in which quantized values of linear prediction coefficients have been stored. The fifth excitation vector output by the adder 40 and an index corresponding to a quantized value of a linear prediction coefficient output by the first linear prediction coefficient calculation circuit 140 enter the linear prediction filter 150. The quantized value of the linear prediction coefficient corresponding to this index is read out of this table and the filter thus set to this quantized linear prediction coefficient is driven by the fifth excitation vector, whereby a reconstructed signal (reconstructed vector) is obtained. This vector is output to a subtractor 50 and to the higher-order linear prediction coefficient calculation circuit 180.

The reconstructed vector output by the linear prediction filter 150 enters the higher-order linear prediction coefficient calculation circuit 180, which proceeds to calculate the third higher-order linear prediction coefficient and the fourth higher-order linear prediction coefficient. The third higher-order linear prediction coefficient is output to the first higher-order linear prediction filter 130, and the fourth higher-order linear prediction coefficient is output to the second higher-order linear prediction filter 131. The details of construction of the higher-order linear prediction coefficient calculation circuit 180 will be described later.

The input vector enters the subtractor 50 via the input terminal 10, and the reconstructed vector output by the linear prediction filter 150 also enters the subtractor 50. The subtractor 50 calculates the difference between these two inputs. The subtractor 50 outputs a difference vector, which is the difference between the input vector and the reconstructed vector, to the weighting filter 160.

The difference vector output by the subtractor 50 and the linear prediction coefficient output by the first linear prediction coefficient calculation circuit 140 enter the weighting filter 160. The latter uses this linear prediction coefficient to produce a weighting filter corresponding to the characteristic of the human sense of hearing and drives this weighting filter by the difference vector, whereby there is obtained a weighted difference vector. The weighted difference vector is output to the minimizing circuit 670. For a discussion of a weighting filter, see Reference 1.

Weighted difference vectors output by the weighting filter 160 successively enter the minimizing circuit 670, which proceeds to calculate the norms.

Indices corresponding to all values of the elements of the first pulse position vector in the first pulse position generating circuit 610 are output successively from the minimizing circuit 670 to the first pulse position generating circuit 610. Indices corresponding to all values of the elements of the second pulse position vector in the second pulse position generating circuit 611 are output successively from the minimizing circuit 670 to the second pulse position generating circuit 611. Indices corresponding to all first pulse amplitude vectors that have been stored in the first pulse amplitude generating circuit 120 are output successively from the minimizing circuit 670 to the first pulse amplitude generating circuit 120. Indices corresponding to all second pulse amplitude vectors that have been stored in the second pulse amplitude generating circuit 121 are output successively from the minimizing circuit 670to the second pulse amplitude generating circuit 121. Indices corresponding to all first gains that have been stored in the first gain circuit 30 are output successively from the minimizing circuit 670 to the first gain circuit 30. Indices corresponding to all second gains that have been stored in the second gain circuit 31 are output successively from the minimizing circuit 670 to the second gain circuit 31. Further, the minimizing circuit 670 selects the value of each element in the first pulse position vector, the value of each element in the second pulse position vector, the first pulse amplitude vector, the second pulse amplitude vector and the first gain and second gain that will result in the minimum norm and outputs the indices corresponding to these to the code output circuit 690.

With regard to a method of obtaining the position of each pulse that is an element of a pulse position vector as well as the amplitude value of each pulse that is an element of a pulse amplitude vector, see Reference 4, by way of example.

The index corresponding to the quantized value of the linear prediction coefficient output by the first linear prediction coefficient calculation circuit 140 enters the code output circuit 690 and so do the indices corresponding to the value of each element in the first pulse position vector, the value of each element in the second pulse position vector, the first pulse amplitude vector, the second pulse amplitude vector and the first gain and second gain. The code output circuit 690 converts these indices to a bit-sequence code and outputs the code via an output terminal 60.

The higher-order linear prediction coefficient calculation circuit 180 will now be described with reference to FIG. 11.

As shown in FIG. 11, the reconstructed vector output by the linear prediction filter 150 enters a second linear prediction coefficient calculation circuit 910 via an input terminal 900. The second linear prediction coefficient calculation circuit 910 subjects this reconstructed vector to linear prediction analysis obtains a linear prediction coefficient and outputs this coefficient to a residual signal calculation circuit 920 as a second linear prediction coefficient.

The second linear prediction coefficient output by the second linear prediction coefficient calculation circuit 910 and the reconstructed vector output by the linear prediction filter 150 enter the residual signal calculation circuit 920, which proceeds to use a filter, in which the second linear prediction coefficient has been set, to subject the reconstructed vector to inverse filtering, whereby a first residual vector is obtained. The first residual vector is output to an FFT (Fast-Fourier Transform) circuit 930.

The FFT circuit 930, to which the first residual vector output by the residual signal calculation circuit 920 is applied, subjects this vector to a Fourier transform and outputs the Fourier coefficients thus obtained to a band splitting circuit 940.

The band splitting circuit 940, to which the Fourier coefficients output by the FFT circuit 930 are applied, equally partitions these Fourier coefficients into high- and low-frequency regions, thereby obtaining low-frequency Fourier coefficients and high-frequency Fourier coefficients. The low-frequency coefficients are output to a first downsampling circuit 950 and the high-frequency coefficients are output to a second downsampling circuit 951.

The first downsampling circuit 950 downsamples the low-frequency Fourier coefficients output by the band splitting circuit 940. Specifically, the first downsampling circuit 950 removes bands corresponding to high frequency in the low-frequency Fourier coefficients and generates first Fourier coefficients the band whereof is half the full band. The first Fourier coefficients are output to a first inverse FFT circuit 960.

The second downsampling circuit 951 downsamples the high-frequency Fourier coefficients output by the band splitting circuit 940. Specifically, the second downsampling circuit 951 removes bands corresponding to low frequency in the high-frequency Fourier coefficients and loops back the high-frequency coefficients to the low-frequency side, thereby generating second Fourier coefficients the band whereof is half the full band. The second Fourier coefficients are output to a second inverse FFT circuit 961.

The first Fourier coefficients output by the first downsampling circuit 950 enter the first inverse FFT circuit 960, which proceeds to subject these coefficients to an inverse FFT, thereby obtaining a second residual vector that is output to a first higher-order linear prediction coefficient calculation circuit 970.

The second Fourier coefficients output by the second downsampling circuit 951 enter the second inverse FFT circuit 961, which proceeds to subject these coefficients to an inverse FFT, thereby obtaining a third residual vector that is output to a second higher-order linear prediction coefficient calculation circuit 971.

The second residual vector output by the first inverse FFT circuit 960 enters the first higher-order linear prediction coefficient calculation circuit 970, which proceeds to subject the second residual vector to higher-order linear prediction analysis, thereby obtaining the first higher-order linear prediction coefficient. This is output to a first upsampling circuit 980.

The third residual vector output by the second inverse FFT circuit 961 enters the second higher-order linear prediction coefficient calculation circuit 971, which proceeds to subject the third residual vector to higher-order linear prediction analysis, thereby obtaining the second higher-order linear prediction coefficient. This is output to a second upsampling circuit 981.

The first higher-order linear prediction coefficient output by the first higher-order linear prediction coefficient calculation circuit 970 enters the first upsampling circuit 980. By inserting zeros in alternation with the first higher-order linear prediction coefficient, the first upsampling circuit 980 obtains an upsampled prediction coefficient. This is output as the third higher-order linear prediction coefficient to the first higher-order linear prediction filter 130 via an output terminal 901.

The second higher-order linear prediction coefficient output by the second higher-order linear prediction coefficient calculation circuit 971 enters the second upsampling circuit 981. By inserting zeros in alternation with the second higher-order linear prediction coefficient, the second upsampling circuit 981 obtains an upsampled prediction coefficient. This is output as the fourth higher-order linear prediction coefficient to the second higher-order linear prediction filter 131 via an output terminal 902.

FIG. 12 is a block diagram showing an example of the construction of an apparatus for decoding speech and music according to the prior art. Components in FIG. 12 identical with or equivalent to those of FIG. 10 are designated by like reference characters.

As shown in FIG. 12, a code in the form of a bit sequence enters from an input terminal 200. A code input circuit 720 converts the bit-sequence code that has entered from the input terminal 200 to an index.

The code input circuit 720 outputs an index corresponding to each element in the first pulse position vector to a first pulse position generating circuit 710, outputs an index corresponding to each element in the second pulse position vector to a second pulse position generating circuit 711, outputs an index corresponding to the first pulse amplitude vector to the first pulse amplitude generating circuit 120, outputs an index corresponding to the second pulse amplitude vector to the second pulse amplitude generating circuit 121, outputs an index corresponding to the first gain to the first gain circuit 30, outputs an index corresponding to the second gain to the second gain circuit 31, and outputs an index corresponding to the quantized value of a linear prediction coefficient to the linear prediction filter 150.

The index output by the code input circuit 720 enters the first pulse position generating circuit 710, which proceeds to generate the first pulse position vector using the position of each pulse specified by the index and output the vector to the first sound source generating circuit 20.

The first pulse amplitude generating circuit 120 has a table in which M-dimensional vectors $A^-_j$, j=1, . . . , $N_A$ have been stored. The index output by the code input circuit 720 enters the first pulse amplitude generating circuit 120, which proceeds to read an M-dimensional vector $A^-_i$ corresponding to this index out of the above-mentioned table and to output this vector to the first sound source generating circuit 20 as a first pulse amplitude vector.

The index output by the code input circuit 720 enters the second pulse position generating circuit 711, which proceeds to generate the second pulse position vector using the position of each, pulse specified by the index and output the vector to the second sound source generating circuit 21.

The second pulse amplitude generating circuit 121 has a table in which M-dimensional vectors $B^-_j$, j=1, . . . , $N_B$ have been stored. The index output by the code input circuit 720 enters the second pulse amplitude generating circuit 121, which proceeds to read an M-dimensional vector $B^-_j$ corresponding to this index out of the above-mentioned table and to output this vector to the second sound source generating circuit 21 as a second pulse amplitude vector.

The first pulse position vector $P^-=(P^-_1, P_2, \ldots, P_M)$ output by the first pulse position generating circuit 710 and the first pulse amplitude vector $A^-_i=(A_{i1}, A_{i2}, \ldots, A_{iM})$ output by the first pulse amplitude generating circuit 120 enter the first sound source generating circuit 20. The first sound source generating circuit 20 outputs an N-dimensional vector for which the values of the $P_1$st, $P_2$nd , . . . , $P_M$th elements are $A_{i1}, A_{i2}, \ldots, A_{iM}$, respectively, and the values of the other elements are zero to the first gain circuit 30 as a first sound source signal vector.

The second pulse position vector $Q^-=(Q_1, Q_2, \ldots, Q_M)$ output by the second pulse position generating circuit 711 and the second pulse amplitude vector $B^-_j=(B_{i1}, B_{i2}, \ldots, B_{iM})$ output by the second pulse amplitude generating circuit 121 enter the second sound source generating circuit 21. The second sound source generating circuit 21 outputs an N-dimensional vector for which the values of the $Q_1$st, $Q_2$nd, . . . , $Q_M$th elements are $B_{i1}, B_{i2}, \ldots, B_{iM}$, respectively, and the values of the other elements are zero to the second gain circuit 31 as a second sound source signal.

The first gain circuit 30 has a table in which gain values have been stored. The index output by the code input circuit 720 and the first sound source vector output by the first sound source generating circuit 20 enter the first gain circuit 30, which proceeds to read a first gain corresponding to the index out of the table, multiply the first gain by the first sound source vector to thereby generate a third sound source vector and output the generated third sound source vector to the first higher-order linear prediction filter 130.

The first gain circuit 31 has a table in which gain values have been stored. The index output by the code input circuit 720 and the second sound source vector output by the second sound source generating circuit 21 enter the second gain circuit 31, which proceeds to read a second gain corresponding to the index out of the table, multiply the second gain by the second sound source vector to thereby generate a fourth sound source vector and output the generated fourth sound source vector to a second higher-order linear prediction filter 131.

The third higher-order linear prediction coefficient output by the higher-order linear prediction coefficient calculation circuit 180 and the-third sound source vector output by the first gain circuit 30 enter the first higher-order linear prediction filter 130. The filter thus set to the third higher-order linear prediction coefficient is driven by the third sound source vector, whereby a first excitation vector is obtained. The first excitation vector is output to the first band-pass filter 135.

The fourth higher-order linear prediction coefficient output by the higher-order linear prediction coefficient calculation circuit 180 and the fourth sound source vector output by the second gain circuit 31 enter the second higher-order linear prediction filter 131. The filter thus set to the fourth higher-order linear prediction coefficient is driven by the fourth sound source vector, whereby a second excitation vector is obtained. The second excitation vector is output to the second band-pass filter 136.

The first excitation vector output by the first higher-order linear prediction filter 130 enters the first band-pass filter 135. The first excitation vector has its band limited by the filter 135, whereby a third excitation vector is obtained. The first band-pass filter 135 outputs the third excitation vector to the adder 40.

The second excitation vector output by the second higher-order linear prediction filter 131 enters the second band-pass filter 136. The second excitation vector has its band limited by the filter 136, whereby a fourth excitation vector is obtained. The fourth excitation vector is output to the adder 40.

The adder 40 adds the inputs applied thereto, namely the third excitation vector output by the first band-pass filter 135 and the fourth excitation vector output by the second band-pass filter 136, and outputs a fifth excitation vector, which is the sum of the third and fourth excitation vectors, to the linear prediction filter 150.

The linear prediction filter 150 has a table in which quantized values of linear prediction coefficients have been stored. The fifth excitation vector output by the adder 40 and an index corresponding to a quantized value of a linear prediction coefficient output by the code input circuit 720 enter the linear prediction filter 150. The latter reads the quantized value of the linear prediction coefficient corresponding to this index out of the table and drives the filter thus set to this quantized linear prediction coefficient by the fifth excitation vector, whereby a reconstructed vector is obtained.

The reconstructed vector obtained is output to an output terminal 201 and to the higher-order linear prediction coefficient calculation circuit 180.

The reconstructed vector output by the linear prediction filter 150 enters the higher-order linear prediction coefficient calculation circuit 180, which proceeds to calculate the third higher-order linear prediction coefficient and the fourth higher-order linear prediction coefficient. The third higher-order linear prediction is output to the first higher-order linear prediction filter 130, and the fourth higher-order linear prediction coefficient is output to the second higher-order linear prediction filter 131.

The reconstructed vector calculated by the linear prediction filter 150 is output via the output terminal 201.

SUMMARY OF THE DISCLOSURE

In the course of investigations toward the present invention, the following problem has been encountered. Namely, a problem with the conventional apparatus for encoding and decoding speech and musical signals by the above-described band splitting technique is that a large number of bits is required to encode the sound source signals.

The reason for this is that the sound source signals are encoded independently in each band without taking into consideration the correlation between bands of the input signals.

Accordingly, an object of the present invention is to provide an apparatus for encoding and decoding speech and musical signals, wherein the sound source signal of each band can be encoded using a small number of bits.

Another object of the present invention is to provide an apparatus for encoding or decoding speech and musical (i.e., sound) signals with simplified structure and/or high efficiency. Further objects of the present invention will become apparent in the entire disclosure. Generally, the present invention contemplates to utilize the correlation between bands of the input signals upon encoding/decoding in such a, fashion to reduce the entire bit number.

According to a first aspect of the present invention, the foregoing object is attained by providing a speech and musical signal encoding apparatus which, when encoding an input signal upon splitting the input signal into a plurality of bands, generates a reconstructed signal using a multipulse sound source signal that corresponds to each band, wherein a position obtained by shifting the position of each pulse which defines the multipulse signal in the band(s) is used when defining a multipulse signal in the other band(s).

According to a second aspect of the present invention, the foregoing object is attained by providing a speech and musical signal decoding apparatus for generating a reconstructed signal using a multipulse sound source signal corresponding to each of a plurality of bands, wherein a position obtained by shifting the position of each pulse which defines the multipulse signal in the band(s) is used when defining a multipulse signal in the other band(s).

According to a third aspect of the present invention, the foregoing object is attained by providing a speech and musical signal encoding apparatus which, when encoding an input signal upon splitting the input signal into a plurality of bands, generates a reconstructed signal by exciting a synthesis filter by a full-band sound source signal, which is obtained by summing, over all bands, multipulse sound source signals corresponding to respective ones of the plurality of bands, wherein a position obtained by shifting the position of each pulse which defines the multipulse signal in the band(s) is used when defining a multipulse signal in the other band(s).

According to a fourth aspect of the present invention, the foregoing object is attained by providing a speech and musical signal decoding apparatus for generating a reconstructed signal by exciting a synthesis filter by a full-band sound source signal, which is obtained by summing, over all bands, multipulse sound source signals corresponding to respective ones of a plurality of bands, wherein a position obtained by shifting the position of each pulse which defines the multipulse signal in the band(s) is used when defining a multipulse signal in the other band(s).

According to a fifth aspect of the present invention, the foregoing object is attained by providing a speech and musical signal encoding apparatus which, when encoding an input signal upon splitting the input signal into a plurality of bands, generates a reconstructed signal by exciting a synthesis filter by a full-band sound source signal, which is obtained by summing, over all bands, signals obtained by exciting a higher-order linear prediction filter, which represents a microspectrum relating to the input signal of each band, by a multi pulse sound source signal corresponding to each band, wherein a position obtained by shifting the position of each pulse which defines the multipulse signal in the band(s) is used when defining a multipulse signal in the other band(s).

According to a sixth aspect of the present invention, the foregoing object is attained by providing a speech and musical signal decoding apparatus for generating a reconstructed signal by exciting a synthesis filter by a full-band sound source signal, which is obtained by summing, over all bands, signals obtained by exciting a higher-order linear prediction filter, which represents a microspectrum relating to an input signal of each of a plurality of bands, by a multipulse sound source signal corresponding to each band, wherein a position obtained by shifting the position of each pulse which defines the multipulse signal in the band(s) is used when defining a multipulse signal in the other band(s).

According to a seventh aspect of the present invention, the foregoing object is attained by providing a speech and musical signal encoding apparatus which, when encoding an input signal upon splitting the input signal into a plurality of bands, generates a reconstructed signal by exciting a synthesis filter by a full-band sound source signal, which is obtained by summing, over all bands, signals obtained by exciting a higher-order linear prediction filter, which represents a microspectrum relating to the input signal of each band, by a multipulse sound source signal corresponding to each band, wherein a residual signal is found-by inverse filtering of the reconstructed signal using a linear prediction filter for which linear prediction coefficients obtained from the reconstructed signal have been decided, conversion coefficients obtained by converting the residual signal are split into bands, and the higher-order linear prediction filter uses coefficients obtained from a residual signal of each band generated in each band by back-converting the conversion coefficients that have been split into the bands.

According to an eighth aspect of the present invention, the foregoing object is attained by providing a speech and musical signal decoding apparatus for generating a reconstructed signal by exciting a synthesis filter by a full-band sound source signal, which is obtained by summing, over all bands, signals obtained by exciting a higher-order linear prediction filter, which represents a microspectrum relating to an input signal of each of a plurality of bands, by a multipulse sound source signal corresponding to each band, wherein a residual signal is found by inverse filtering of the reconstructed signal using a linear prediction filter for which linear prediction coefficients obtained from the reconstructed signal have been decided, conversion coefficients obtained by converting the residual signal are split into bands, and the higher-order linear prediction filter uses coefficients obtained from a residual signal of each band generated in each band by back-converting the conversion coefficients that have been split into the bands.

According to a ninth aspect of the present invention, in the fifth aspect of the invention a residual signal is found by inverse filtering of the reconstructed signal using a linear prediction filter for which linear prediction coefficients obtained from the reconstructed signal have been decided, conversion coefficients obtained by converting the residual signal are split into bands, and the higher-order linear prediction filter uses coefficients obtained from a residual signal of each band generated in each band by back-converting the conversion coefficients that have been split into the bands.

According to a tenth aspect of the present invention, in the sixth aspect of the invention a residual signal is found by inverse filtering of the reconstructed signal using a linear predictions filter for which linear prediction coefficients obtained from the reconstructed signal have been decided, conversion coefficients obtained by converting the residual signal are split into bands , and the higher-order linear prediction filter uses coefficients obtained from a residual signal of each band generated in each band by back-converting the conversion coefficients that have been split into the bands.

Other features a nd advantages of t he present invention will be apparent from the following description taken in conjunction with the accompanying drawings, in which like reference characters designate the same or similar parts throughout the figures thereof.

DESCRIPTION OF THE PREFERRED EMBODIMENTS

Preferred modes of practicing the present invention will now be described. An apparatus for encoding speech and musical signals according to the present invention in a first preferred mode thereof generates a reconstructed signal using a multipulse sound source signal that corresponds to each of a plurality of bands when a speech input signal is encoded upon being split into a plurality of bands, wherein some of the information possessed by a sound source signal encoded in a certain band is used to encode a sound source signal in another band. More specifically, the encoding apparatus has means (a first pulse position generating circuit 110, a second pulse position generating circuit 111 and a minimizing circuit 170 shown in FIG. 1) for using a position obtained by shifting the position of each pulse, which defines the multipulse signal in the band or bands, when a multipulse signal in the other band(s) is defined.

Figure 1:
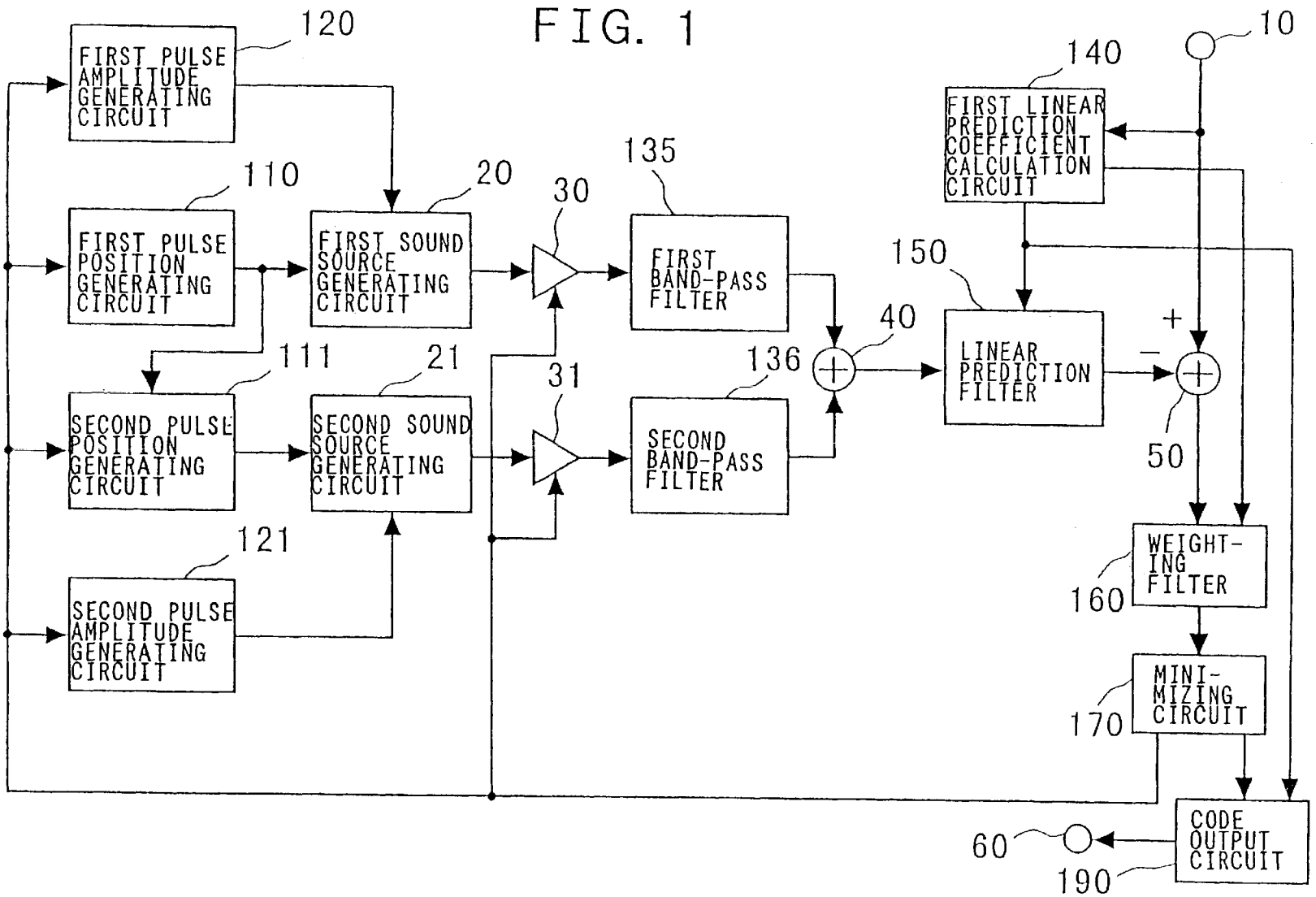
FIG. 1 is a block diagram illustrating the construction of a first embodiment of an apparatus for encoding speech and musical signals according to the present invention.

More specifically, in regard to a case where the number of bands is two, for example, an index output by the minimizing circuit 170 in FIG. 1 and a first pulse position vector $P^{-}=(P_1, P_2, \ldots, P_M)$ output by the minimizing circuit 170 enter the second pulse position generating circuit 111. The latter revises the first pulse position vector using a pulse position revision quantity $d^{-}_i=(d_{i1}, d_{i2}, \ldots, d_{iM})$ specified by the index and outputs the revised vector to the second sound source generating circuit 21 in FIG. 1 as a second pulse position vector $P^{-t}=(P_1+d_{i1}, P_2+d_{i2}, \ldots, P_M+d_{iM})$.

An apparatus for decoding speech and musical signals according to the present invention in the first preferred mode thereof uses some of the information possessed by a sound source signal decoded in certain band or bands to decode a sound source signal in another band or the other bands.

Figure 2:
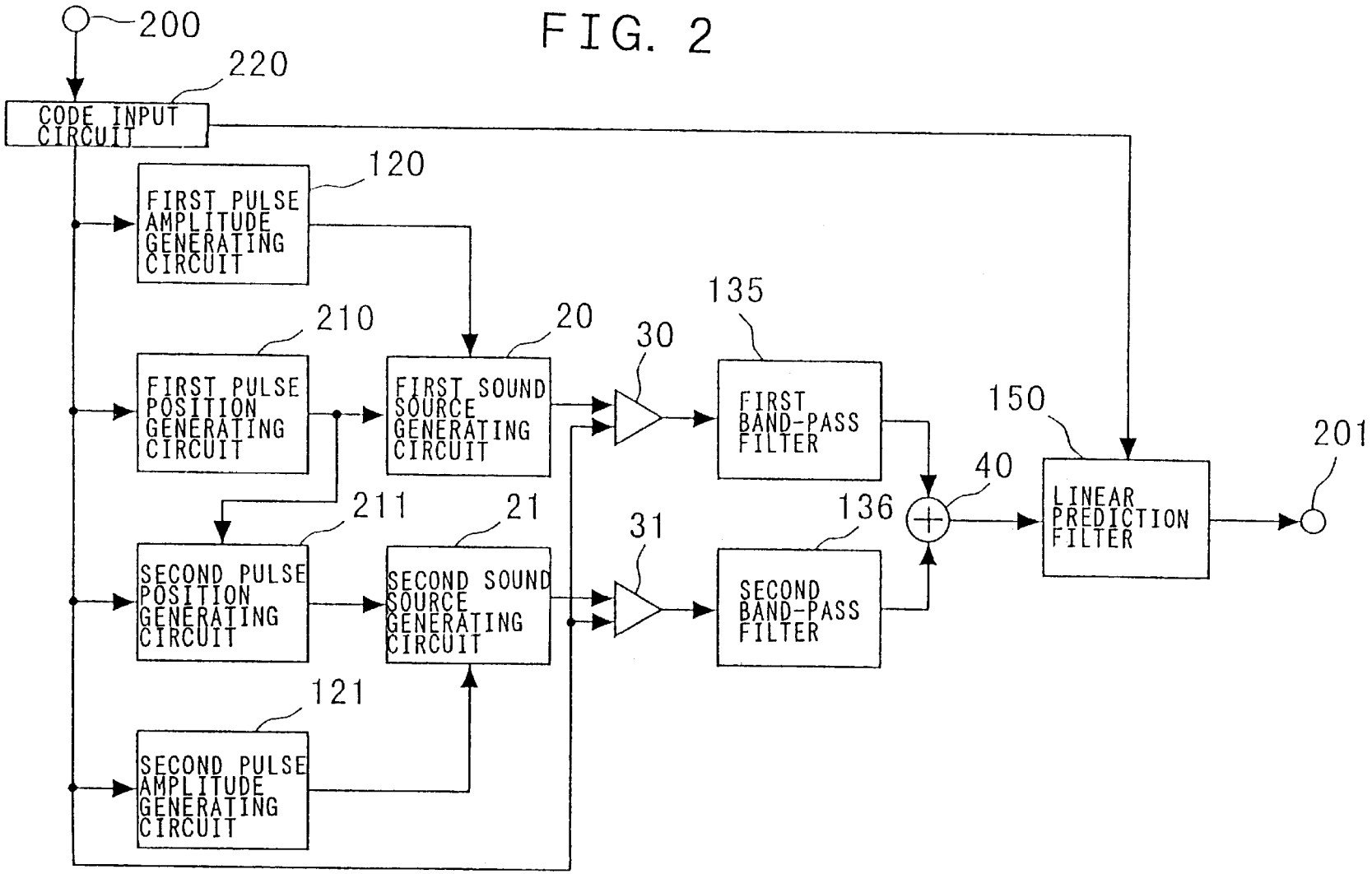
FIG. 2 is a block diagram illustrating the construction of a first embodiment of an apparatus for decoding speech and musical signals according to the present invention.

More specifically, the decoding apparatus has means (a first pulse position generating circuit 210, a second pulse position generating circuit 211 and a code input circuit 220 shown in FIG. 2) for using a position obtained by shifting the position of each pulse, which defines the multipulse signal in the band, when a multipulse signal in another band is defined.

An apparatus for encoding speech and musical signals according to the present invention in a second preferred mode thereof generates a reconstructed signal by exciting a synthesis filter by a full-band sound source signal, which is obtained by summing, over all bands, multipulse sound source signals corresponding to respective ones of the plurality of bands. More specifically, the encoding apparatus has means (110, 111 , 170 in FIG. 1) for using a position obtained by shifting the position of each pulse, which defines the multipulse signal in the band(s), when a multipulse signal in the other band(s) is defined, means (adder 40 in FIG. 1) for obtaining the full-band sound source signal by summing, over all bands, multi pulse sound source signals corresponding to respective ones of the bands, and means (linear prediction filter 150 in FIG. 1) for generating the reconstructed signal by exciting the synthesis filter by the full-band sound source signal.

An apparatus for decoding speech and musical signals according to the present invention in the second preferred mode thereof generates a reconstructed signal by exciting a synthesis filter by a full-band sound source signal, which is obtained by summing, over all bands, multipulse sound source signals corresponding to respective ones of the plurality of bands. More specifically, the decoding apparatus has means (210, 211 and 220 in FIG. 2) for using a position obtained by shifting the position of each pulse, which defines the multipulse signal in the band(s), when a multipulse signal in the other band(s) is defined; means (adder 40 in FIG. 2) for obtaining the full-band sound source signal by summing, over all bands, multipulse sound source signals corresponding to respective ones of the bands; and means (linear prediction filter 150 in FIG. 1) for generating the reconstructed signal by exciting the synthesis filter by the full-band sound source signal.

An apparatus for encoding speech and musical signals according to the present invention in a third preferred mode thereof generates a reconstructed signal by exciting a synthesis filter by a full-band sound source signal, which is obtained by summing, over all bands, signals obtained by exciting a higher-order linear prediction filter, which represents a microspectrum relating to the input signal of each band, by a multipulse sound source signal corresponding to each band. More specifically, the encoding apparatus has means (the first pulse position generating circuit 110, second pulse position generating circuit 111 and minimizing circuit 170 shown in FIG. 1) for using a position obtained by shifting the position of each pulse, which defines the multipulse signal in the band(s), when a multipulse signal in the other band(s) is defined; means (first and second higher-order linear prediction filters 130, 131 in FIG. 3) for exciting the higher-order linear prediction filter by the multipulse sound source signal corresponding to each band; means (adder 40 in FIG. 3) for obtaining the full-band sound source signal by summing, over all bands, signals obtained by exciting the higher-order linear prediction filter; and means (linear prediction filter 150 in FIG. 3) for generating the reconstructed signal by exciting the synthesis filter by the full-band sound source signal.

An apparatus for decoding speech and musical signals according to the present invention in the third preferred mode thereof generates a reconstructed signal by exciting a synthesis filter by a full-band sound source signal, which is obtained by summing, over all bands, signals obtained by exciting a higher-order linear prediction filter, which represents a microspectrum relating to the input signal of each band, by a multipulse sound source signal corresponding to each band. More specifically, the decoding apparatus has means (first pulse position generating circuit 210, second pulse position generating circuit 211 and code input circuit 220 shown in FIG. 4) for using a position obtained by shifting the position of each pulse, which defines the multipulse signal in the band(s), when a multipulse signal in the other band(s) is defined; means (first and second higher-order linear prediction filters 130, 131 in FIG. 4) for exciting the higher-order linear prediction filter by the multipulse sound source signal corresponding to each band; means (adder 40 in FIG. 4) for obtaining the full-band sound source signal by summing, over all bands, signals obtained by exciting the higher-order linear prediction filter; and means (linear prediction filter 150 in FIG. 4) for generating the reconstructed signal by exciting the synthesis filter by the full-band sound source signal.

In a fourth preferred mode of the present invention, the apparatus for encoding speech and musical signals of the third mode is characterized in that a higher-order linear prediction calculation circuit is implemented by a simple arrangement. More specifically, the encoding apparatus has means (second linear prediction coefficient calculation circuit 910 and residual signal calculation circuit 920 in FIG. 6) for obtaining a residual signal by inverse filtering of the reconstructed signal using a linear prediction filter for which linear prediction coefficients obtained from the reconstructed signal have been decided and set; means (FFT circuit 930 and band splitting circuit 540 in FIG. 6) for splitting, into bands, conversion coefficients obtained by converting the residual signal; and means (first zerofill circuit 550, second zerofill circuit 551, first inverse FFT circuit 560, second inverse FFT circuit 561, first higher-order linear prediction coefficient calculation circuit 570 and second higher-order linear prediction coefficient calculation circuit 571 in FIG. 6) for outputting, to the higher-order linear prediction filter, coefficients obtained from a residual signal of each band generated in each band by back-converting the conversion coefficients that have been split into the bands.

In a fourth preferred mode of the present invention, the apparatus for decoding speech and musical signals of the third mode is characterized in that a higher-order linear prediction calculation circuit is implemented by a simple arrangement. More specifically, the encoding apparatus has means (910, 920 in FIG. 6) for obtaining a residual signal by inverse filtering of the reconstructed signal using a linear prediction filter for which linear prediction coefficients obtained from the reconstructed signal have been decided; means (930, 540 in FIG. 6) for splitting, into bands, conversion coefficients obtained by converting the residual signal; and means (550, 551, 560, 561, 570, 571 in FIG. 6) for outputting, to the higher-order linear prediction filter, coefficients obtained from a residual signal of each band generated in each band by back-converting the conversion coefficients that have been split into the bands.

In a fifth preferred mode of the present invention, the apparatus for encoding speech and musical signals of the fourth mode is further characterized in that the sound source signal of each band s encoded independently. More specifically, the encoding apparatus has means (first pulse position generating circuit 510, second pulse position generating circuit 511 and minimizing circuit 670 in FIG. 8) for separately obtaining, in each band, the position of each pulse defining the multipulse signal.

In the fifth preferred mode of the present invention, the apparatus for decoding speech and musical signals of the fourth mode is further characterized in that the sound source signal of each band is decoded independently. More specifically, the decoding apparatus has means (first pulse position generating circuit 710, second pulse position generating circuit 711 and code input circuit 720 in FIG. 9) for separately (individually) obtaining, in each band, the position of each pulse defining the multipulse signal.

In the modes of the present invention described above, some of the information possessed by a sound source signal that has been encoded in a certain band or bands is used to encode a sound source signal in the other band or bands. That is, encoding is performed taking into account the correlation between bands possessed by the input signal. More specifically, the position of each pulse obtained by uniformly shifting the positions of the pulses obtained when a multipulse sound source signal is encoded in a first band is used when encoding a sound source signal in a second band.

As a consequence, in relation to the sound source signal in the second band, the number of bits necessary in the conventional method to separately represent the position of each pulse is reduced to a number of bits necessary solely for representing the amount of shift.

As a result, it is possible to reduce the number of bits needed to encode the sound source signal in the second band.

Embodiments of the present invention will now be described with reference to the drawings in order to explain further the modes of the invention set forth above.

[First Embodiment]

FIG. 1 is a block diagram illustrating the construction of a first embodiment of an apparatus for encoding speech and musical signals according to the present invention. Here it is assumed for the sake of simplicity that the number of bands is two.

As shown in FIG. 1, an input vector enters from the input terminal 10. The first linear prediction coefficient calculation circuit 140 receives the input vector as an input from the input terminal 10 and this circuit subjects the input vector to linear prediction analysis, obtains a linear prediction coefficient and quantizes the coefficient. The first linear prediction coefficient calculation circuit 140 outputs the linear prediction coefficient to the weighting filter 160 and outputs an index, which corresponds to a quantized value of the linear prediction coefficient, to the linear prediction filter 150 and to a code output circuit 190.

The first pulse position generating circuit 110 receives as an input an index that is output by the minimizing circuit 170, generates a first pulse position vector $P^-$ using the position of each pulse specified by the index and outputs this vector to the first sound source generating circuit 20 and to the second pulse position generating circuit 111.

Let M represent the number of pulses and let $P_1, P_2, \ldots, P_M$ represent the positions of the pulses. The vector $P^-$, therefore, is written as follows:

$P^-=(P_1, P_2, \ldots, P_M)$

The first pulse amplitude generating circuit 120 has a table in which M-dimensional vectors $A^-_j$, $j=1, \ldots, N_A$ have been stored, where $N_A$ represents the size of the table. The index output by the minimizing circuit 170 enters the first pulse amplitude generating circuit 120, which proceeds to read an M-dimensional vector $A^-_i$ corresponding to this index out of the above-mentioned table and to output this vector to the first sound source generating circuit 20 as a first pulse amplitude vector.

Letting $A_{i1}, A_{i2}, \ldots, A_{iM}$ represent the amplitude values of the pulses, we have $A^-=(A_{i1}, A_{i2}, \ldots, A_{iM})$.

The second pulse position generating circuit 111 receives as inputs the index that is output by the minimizing circuit 170 and the first pulse position vector $P^-=(P_1, P_2, \ldots, P_M)$ output by the first pulse position generating circuit 110, revises the first pulse position vector using the pulse position revision quantity $d^-_i=(d_{i1}, d_{i2}, \ldots, d_{iM})$ specified by the index and outputs the revised vector to the second sound source generating circuit 21 as a second pulse position vector $Q^{-t}=(P_1+d_{i1}, P_2+d_{i2}, \ldots, P_M+d_{iM})$.

The second pulse amplitude generating circuit 121 has a table in which M-dimensional vectors $B^-_j$, $j=1, \ldots, N_B$ have been stored, where $N_B$ represents the size of the table.

The index output by the minimizing circuit 170 enters the second pulse amplitude generating circuit 121, which proceeds to read an M-dimensional vector $B^-_i$ corresponding to this index out of the above-mentioned table and to output this vector to the second sound source generating circuit 21 as a second pulse amplitude vector.

The first pulse position vector $P^-=(P_1, P_2, \ldots, P_M)$ output by the first pulse position generating circuit 110 and the first pulse amplitude vector $A^-_i=(A_{i1}, A_{i2}, \ldots, A_M)$ output by the first pulse amplitude generating circuit 120 enter the first sound source generating circuit 20. The first sound source generating circuit 20 outputs an N-dimensional vector for which the values of the $P_1$st, $P_2$nd, . . . , $P_M$th elements are $A_{i1}, A_{i2}, \ldots, A_{iM}$, respectively, and the values of the other elements are zero to the first gain circuit 30 as a first sound source vector.

A second pulse position vector $Q^{-t}=(Q^t_1, Q^t_2, \ldots, Q^t_M)$ output by the second pulse position generating circuit 111 and a second pulse amplitude vector $B^-_i=(B_{i1}, B_{i2}, \ldots, B_{iM})$ output by the second pulse amplitude generating circuit 121 enter the second sound source generating circuit 21. The second sound source generating circuit 21 outputs an N-dimensional vector for which the values of the $Q^t_1$st, $Q^t_2$nd, . . . , $Q^t_M$th elements are $B_{i1}, B_{i2}, \ldots, B_{iM}$, respectively, and the values of the other elements are zero to a second gain circuit 31 as a second sound source vector.

The first gain circuit 30 has a table in which gain values have been stored. The index output by the minimizing circuit 170 and the first sound source vector output by the first sound source generating circuit 20 enter the first gain circuit 30, which proceeds to read a first gain corresponding to the index out of the table, multiply the first gain by the first sound source vector to thereby generate a third sound source vector, and output the generated third sound source vector to the first band-pass filter 135.

The second gain circuit 31 has a table in which gain values have been stored. The index output by the minimizing circuit 170 and the second sound source vector output by the second sound source generating circuit 21 enter the second gain circuit 31, which proceeds to read a second gain corresponding to the index out of the table, multiply the second gain by the second sound source vector to thereby generate a fourth sound source vector, and output the generated fourth sound source vector to the second band-pass filter 136.

The third sound source vector output by the first gain circuit 30 enters the first band-pass filter 135. The third sound source vector has its band limited by the filter 135, whereby a fifth sound source vector is obtained. The first band-pass filter 135 outputs the fifth sound source vector to the adder 40.

The fourth sound source vector output by the second gain circuit 31 enters the second band-pass filter 136. The fourth sound source vector has its band limited by the filter 136, whereby a sixth sound source vector is obtained. The second band-pass filter 136 outputs the sixth sound source vector to !the adder 40.

The adder 40 adds the inputs applied thereto, namely the fifth sound source vector output by the first band-pass filter 135 and the sixth sound source vector output by the second band-pass filter 136, and outputs an excitation vector, which is the sum of the fifth and sixth sound source vectors, to the linear prediction filter 150.

The linear prediction filter 150 has a table in which quantized values of linear prediction coefficients have been stored. The excitation vector output by the adder 40 and an index corresponding to a quantized value of a linear prediction coefficient, output by the first linear prediction coefficient calculation circuit 140 enter the linear prediction filter 150. The linear prediction filter 150 reads the quantized value of the linear prediction coefficient corresponding to this index out of the table and drives the filter thus set to this quantized linear prediction coefficient by the excitation vector, whereby a reconstructed vector is obtained. The linear prediction filter 150 outputs this reconstructed vector to the subtractor 50.

The input vector enters the subtractor 50 via the input terminal 10, and the reconstructed vector output by the linear prediction filter 150 also enters the subtractor 50. The subtractor 50 calculates the difference between these two inputs. The subtractor 50 outputs a difference vector which is the difference between the input vector and the reconstructed vector, to the weighting filter 160.

The difference vector output by the subtractor 50 and the linear prediction coefficient output by the first linear prediction coefficient calculation circuit 140 enter the weighting filter 160. The latter uses this linear prediction coefficient to produce a weighting filter corresponding to the characteristic of the human sense of hearing and drives this weighting filter by the difference vector, whereby there is obtained a weighted difference vector. The weighted difference vector is output to the minimizing circuit 170.

The weighted difference vector output by the weighting filter 160 enters the minimizing circuit 170, which proceeds to calculate the norm. Indices corresponding to all values of the elements of the first pulse position vector in the first pulse position generating circuit 110 are output successively from the minimizing circuit 170 to the first pulse position generating circuit 110. Indices corresponding to all values of the elements of the second pulse position vector in the second pulse position generating circuit 111 are output successively from the minimizing circuit 170 to the second pulse position generating circuit 111. Indices corresponding to all first pulse amplitude vectors that have been stored in the first pulse amplitude generating circuit 120 are output successively from the minimizing circuit 170 to the first pulse amplitude generating circuit 120. Indices corresponding to all second pulse amplitude vectors that have been stored in the second pulse amplitude generating, circuit 121 are output successively from the minimizing circuit 170to the second pulse amplitude generating circuit 121. Indices corresponding to all first gains that have been stored in the first gain circuit 30 are output successively from the minimizing circuit 170 to the first gain circuit 30. Indices corresponding to all second gains that have been stored in the second gain circuit 31 are output successively from the minimizing circuit 170 to the second gain circuit 31. Further, the minimizing circuit 170 selects the value of each element in the first pulse position vector, the amount of pulse position revision, the first pulse amplitude vector, the second pulse amplitude vector and the first gain and second gain that will result in the minimum norm and outputs the indices corresponding to these to the code output circuit 190.

The index corresponding to the quantized value of the linear prediction coefficients output by the first linear prediction coefficient calculation circuit 140 enters the code output circuit 190 and so do the indices corresponding to the value of each element in the first pulse position vector, the amount of pulse position revision, the first pulse amplitude vector, the second pulse amplitude vector and the first gain and second gain. The code output circuit 190 converts each index to a bit-sequence code and outputs the code via the output terminal 60.

FIG. 2 is a block diagram illustrating the construction of a first embodiment of an apparatus for encoding speech and musical signals according to the present invention. Components in FIG. 2 identical with or equivalent to those of FIG. 1 are designated by like reference characters.

As shown in FIG. 2, a code in the form of a bit sequence enters from the input terminal 200. A code input circuit 220 converts the bit-sequence code that has entered from the input terminal 200 to an index.

The code input circuit 220 outputs an index corresponding to each element in the first pulse position vector to the first pulse position generating circuit 210; outputs an index corresponding to the amount of pulse position revision to the second pulse position generating circuit 211; outputs an index corresponding to the first pulse amplitude vector to the first pulse amplitude generating circuit 120; outputs an index corresponding to the second pulse amplitude vector to the second pulse amplitude generating circuit 121; outputs an index corresponding to the first gain to the first gain circuit 30; outputs an index corresponding to the second gain to the second gain circuit 31; and outputs an index corresponding to the quantized value of a linear prediction coefficient to the linear prediction filter 150.

The index output by the code input circuit 220 enters the first pulse position generating circuit 210, which proceeds to generate the first pulse position vector using the position of each pulse specified by the index and output the vector to the first sound source generating circuit 20 and to the second pulse position generating circuit 211.

The first pulse amplitude generating circuit 120 has a table in which M-dimensional vectors $A^{-}_{j}$, j=1, . . . , $N_A$ have been stored. The index output by the code input circuit 220 enters the first pulse amplitude generating circuit 120, which reads an M-dimensional vector $A^{-}_{j}$ corresponding to this index out of the above-mentioned table and outputs this vector to the first sound source generating circuit 20 as a first pulse amplitude vector.

The index output by the code input circuit 220 and the first pulse position vector $P^{-}=(P_1, P_2, \ldots, P_M)$ output by the first pulse position generating circuit 210 enter the second pulse position generating circuit 211. The latter revises the first pulse position vector using the pulse position revision quantity $d^{-}_{i}=(d_{i1}, d_{i2}, \ldots, d_{iM})$ specified by the index and outputs the revised vector to the second sound source generating circuit 21 as a second pulse position vector $Q^{-t}=(P_1+d_{i1}, P_2+d_{i2}, \ldots, P_M+d_{iM})$.

The second pulse amplitude generating circuit 121 has a table in which M-dimensional vectors $B^{-}_{j}$, j=1, . . . , $N_B$ have been stored. The index output by the code input circuit 220 enters the second pulse amplitude generating circuit 121, which reads an M-dimensional vector $B^{-}_{i}$ corresponding to this index out of the above-mentioned table and outputs this vector to the second sound source generating circuit 21 as a second pulse amplitude vector.

The first pulse position vector $P^{-}=(P_1, P_2, \ldots, P_M)$ output by the first pulse,position generating circuit 210 and the first pulse amplitude vector $A^{-}_{i}=(A_{i1}, A_{i2}, \ldots, A_{iM})$ output by the first pulse amplitude generating circuit 120 enter the first sound source generating circuit 20. The first sound source generating circuit 20 outputs an N-dimensional vector for which the values of the $P_1$st, $P_2$nd, $P_M$th elements are $A_{i1}$, $A_{i2}$, . . . , $A_{iM}$, respectively, and the values of the other elements are zero to the first gain circuit 30 as a first sound source vector.

A second pulse position vector $Q^{-t}=(Q^{t}_{1}, Q^{t}_{2}, \ldots, Q^{t}_{M})$ output by the second pulse position generating circuit 211 and a second pulse amplitude vector $B^{-}_{i}=(B_{i1}, B_2, \ldots, B_{iM})$ output by the second pulse amplitude generating circuit 121 enter the second sound source generating circuit 21. The second sound source generating circuit 21 outputs an N-dimensional vector for which the values of the $Q^{t}_{1}$st, $Q^{t}_{2}$nd, . . . , $Q^{t}_{M}$th elements are $B_{i1}$, $B_{i2}$, . . . , $B_{iM}$, respectively, and the values of the other elements are zero to the second gain circuit 31 as a second sound source vector.

The first gain circuit 30 has a table in which gain values have been stored. The index output by the code input circuit 220 and the first sound source vector output by the first sound source generating circuit 20 enter the first gain circuit 30, which reads a first gain corresponding to the index out of the table, multiplies the first gain by the first sound source vector to thereby generate a third sound source vector, and outputs the generated third sound source vector to the first band-pass filter 135.

The second gain circuit 31 has a table in which gain values have been stored. The index output by the code input circuit 220 and the second sound source vector output by the second sound source generating circuit 21 enter the second gain circuit 31, which reads a second gain corresponding to the index out of the table, multiplies the second gain by the second sound source vector to thereby generate a fourth sound source vector, and outputs the generated fourth sound source vector to the second band-pass filter 136.

The third sound source vector output by the first gain circuit 30 enters the first band-pass filter 135. The third sound source vector has its band limited by the filter 135, whereby a fifth sound source vector is obtained. The first band-pass filter 135 outputs the fifth sound source vector to the adder 40.

The fourth sound source vector output by the second gain circuit 31 enters the second band-pass filter 136. The fourth sound source vector has its band limited by the filter 136, whereby a sixth sound source vector is obtained. The second band-pass filter 136 outputs the sixth sound source vector to the adder 40.

The adder 40 adds the inputs applied thereto, namely the fifth sound source vector output by the first band-pass filter 135 and the sixth sound source vector output by the second band-pass filter 136, and outputs an excitation vector, which is thee sum of the fifth and sixth sound source vectors, to the linear prediction filter 150.

The linear prediction filter 150 has a table in which quantized values of linear prediction coefficients have been stored. The excitation vector output by the adder 40 and an index corresponding to a quantized value of a linear prediction coefficient output by the code input circuit 220 enter the linear prediction filter 150. The linear prediction filter 150 reads the quantized value of the linear prediction coefficient corresponding to this index out of the table and drives the filter thus set to this quantized linear prediction coefficient by the excitation vector, whereby a reconstructed vector is obtained. The linear prediction filter 150 outputs this reconstructed vector via the output terminal 201.

[Second Embodiment]

Figure 3:
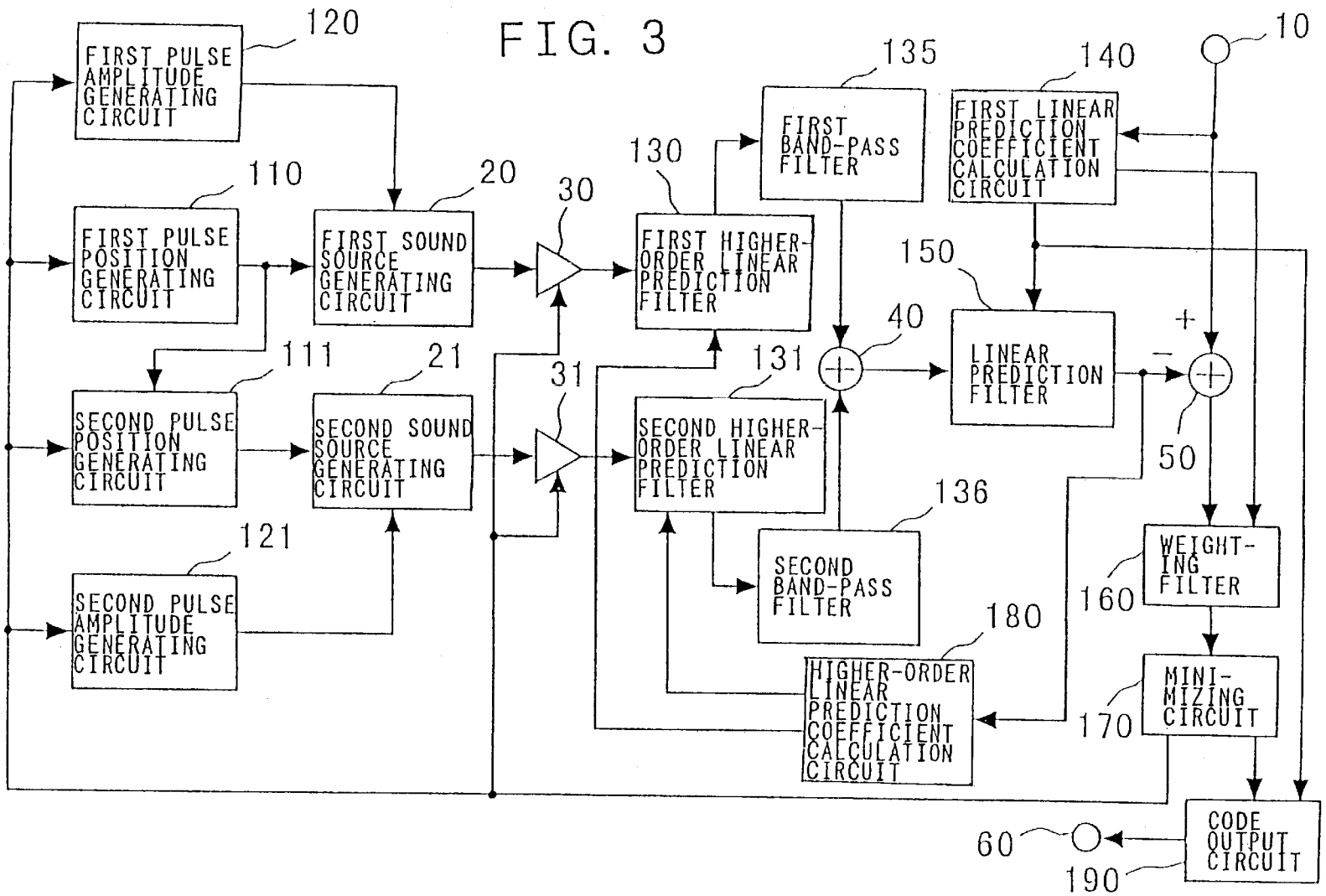
FIG. 3 is a block diagram illustrating the construction of a second embodiment of an apparatus for encoding speech and musical signals according to the present invention.

FIG. 3 is a block diagram illustrating the construction of a second embodiment of an apparatus for encoding speech and musical signals according to the present invention. Here also it is assumed for the sake of simplicity that the number of bands is two.

Figure 10:
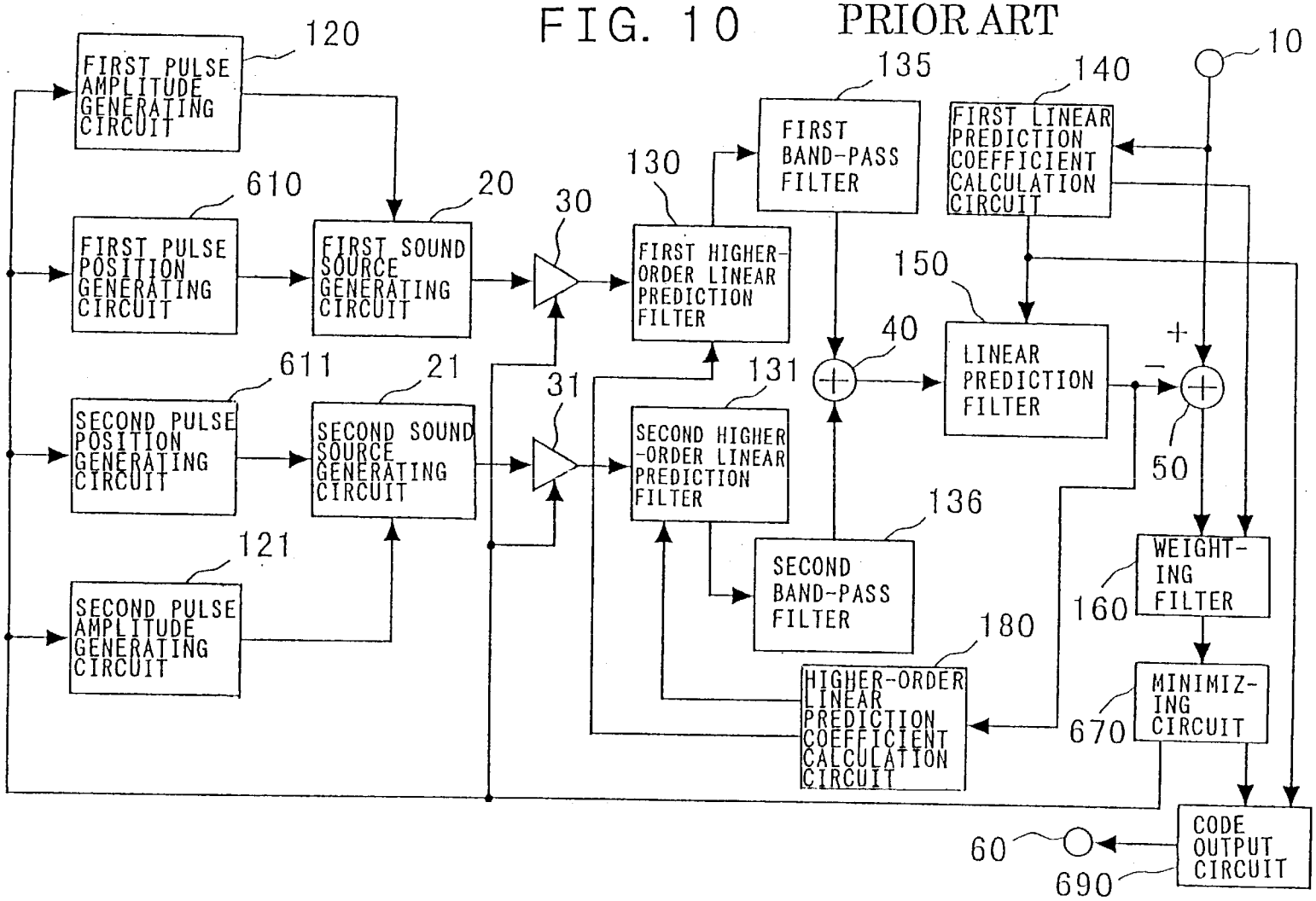
FIG. 10 PRIOR ART
FIG. 10 is a block diagram illustrating the construction of an apparatus for encoding speech and musical signals according to the prior art prior art.

Components in FIG. 3 identical with or equivalent to those of the prior art illustrated in FIG. 10 are designated by like reference characters and are not described again in order to avoid prolixity.

As shown in FIG. 3, the first pulse position generating circuit 110 receives as an input an index that is output by the minimizing circuit 170, generates a first pulse position vector using the position of each pulse specified by the index and outputs this vector to the first sound source generating circuit 20 and to the second pulse position generating circuit 111.

The second pulse position generating circuit 111 receives as inputs the index that is output by the minimizing circuit 170 and the first pulse position vector $P^{-}=(P_1, P_2, \ldots, P_M)$ output by the first pulse position generating circuit 110, revises the first pulse position vector using the pulse position revision quantity $d^{-}_i=(d_{i1}, d_{i2}, \ldots, d_{iM})$ specified by the index and outputs the revised vector to the second sound source generating circuit 21 as a second pulse position vector $Q^{-t}=(P_1+d_{i1}, P_2+d_{i2}, \ldots, P_M+d_{iM})$.

The weighted difference vector output by the weighting filter 160 enters the minimizing circuit 170, which proceeds to calculate the norm. Indices corresponding to all values of the elements of the first pulse position vector in the first pulse position generating circuit 110 are output successively from the minimizing circuit 170 to the first pulse position generating circuit 110. Indices corresponding to all values of the elements of the second pulse position vector in the second pulse position generating circuit 111 are output successively from the minimizing circuit 170 to the second pulse position generating circuit 111. Indices corresponding to all first pulse amplitude vectors that have been stored in the first pulse amplitude generating circuit 120 are output successively from the minimizing circuit 170 to the first pulse amplitude generating circuit 120. Indices corresponding to all second pulse amplitude vectors that have been stored in the second pulse amplitude generating circuit 121 are output successively from the minimizing circuit 170 to the second pulse amplitude generating circuit 121. Indices corresponding to all first gains that have been stored in the first gain circuit 30 are output successively from the minimizing circuit 170 to the first gain circuit 30. Indices corresponding to all second gains that have been stored in the second gain circuit 31 are output successively from the minimizing circuit 170 to the second gain circuit 31 Further, the minimizing circuit 170 selects the value of each element in the first pulse position vector, the amount of pulse position revision, the first pulse amplitude vector, the second pulse amplitude vector and the first gain and second gain that will result in the minimum norm and outputs the indices corresponding to these to the code output circuit 190.

The index corresponding to the quantized value of the linear prediction coefficient output by the first linear prediction coefficient calculation circuit 140 enters the code output circuit 190 and so do the indices corresponding to the value of each element in the first pulse position vector, the amount of pulse position revision, the first pulse amplitude vector, the second pulse amplitude vector and the first gain and second gain. The code output circuit 190 converts these indices to a bit-sequence code and outputs the code via the output terminal 60.

Figure 4:
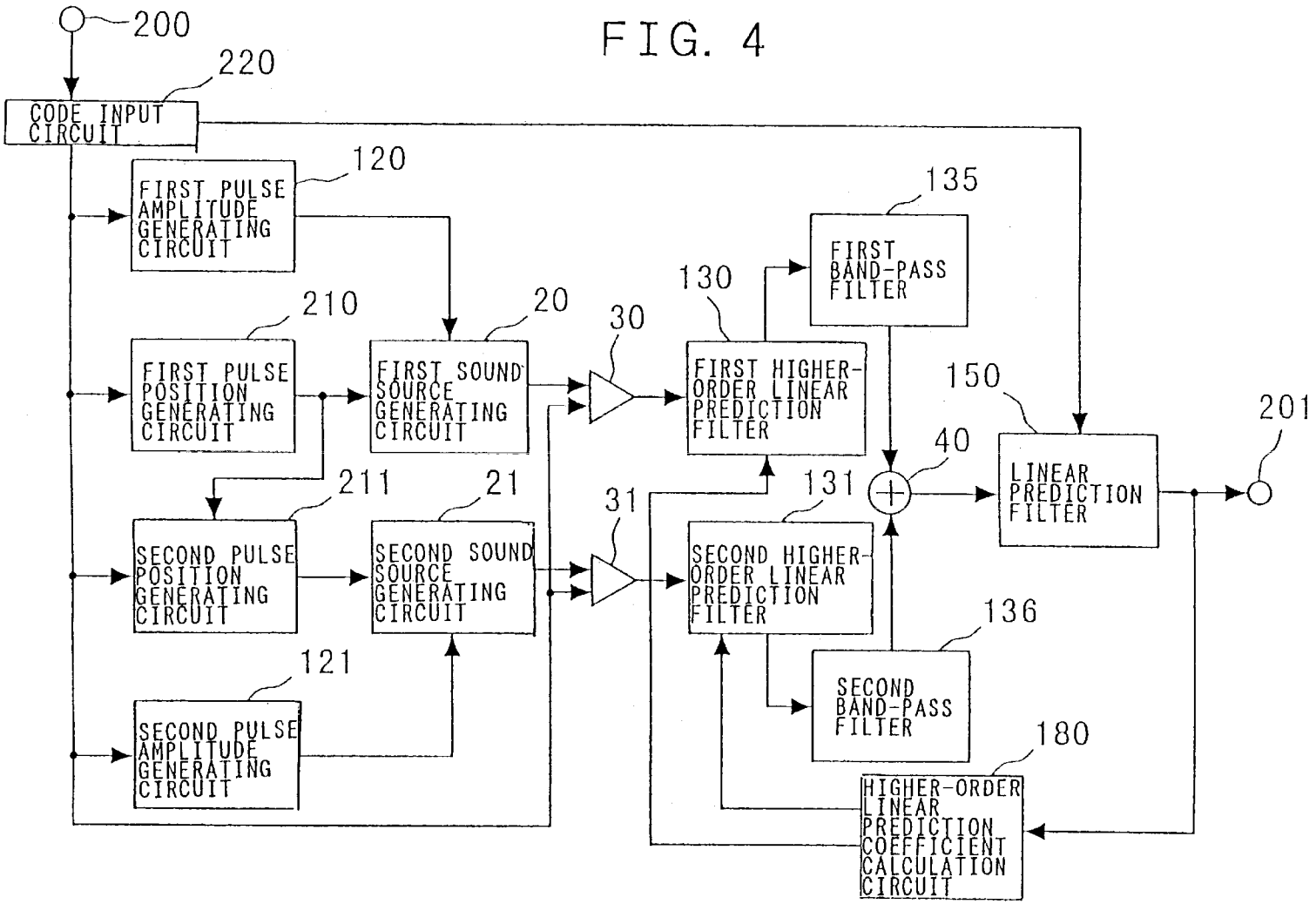
FIG. 4 is a block diagram illustrating the construction of a second embodiment of an apparatus for decoding speech and musical signals according to the present invention.
Figure 12:
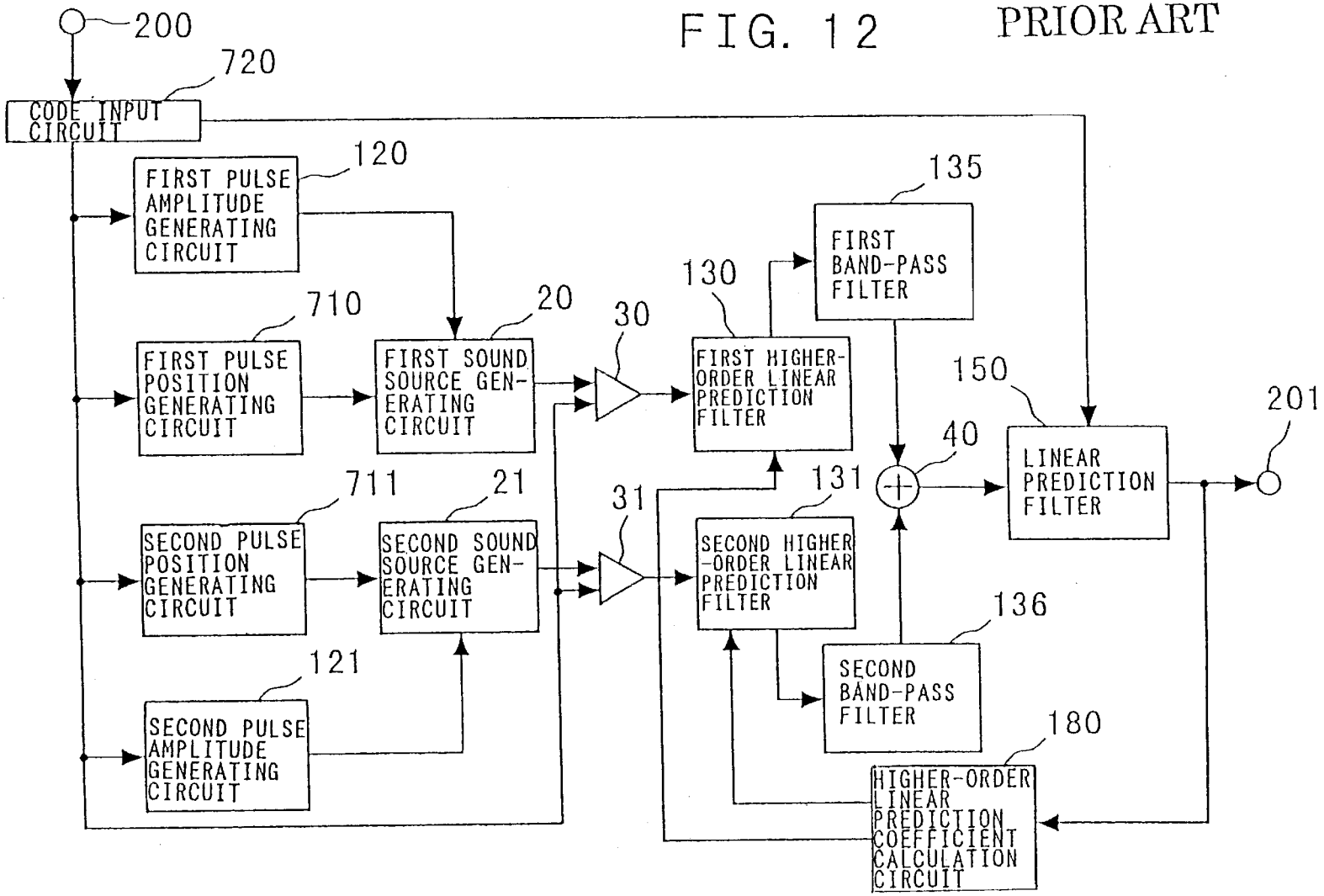
FIG. 12 PRIOR ART
FIG. 12 is a block diagram illustrating the construction of a fourth embodiment of an apparatus for decoding speech and musical signals according to the prior art.

FIG. 4 is a block diagram illustrating the construction of the second embodiment of an apparatus for decoding speech and musical signals according to the present invention. Components in FIG. 4 identical with or equivalent to those of FIGS. 3 and 12 are designated by like reference characters and are not described again in order to avoid prolixity.

As shown in FIG. 4, the code input circuit 220 converts the bit-sequence code that has entered from the input terminal 200 to an index. The code input circuit 220 outputs an index corresponding to each element in the first pulse position vector to the first pulse position generating circuit 210, outputs an index corresponding to the amount of pulse position revision to the second pulse position generating circuit 211, outputs an index corresponding to the first pulse amplitude vector to the first pulse amplitude generating circuit 120, outputs an index corresponding to the second pulse amplitude vector to the second pulse amplitude generating circuit 121, outputs an index corresponding to the first gain to the first gain circuit 30, outputs an index corresponding to the second gain to the second gain circuit 31, and outputs an index corresponding to the quantized value of a linear prediction coefficient to the linear prediction filter 150.

The index output by the code input circuit 220 enters the first pulse position generating circuit 210, which generates the first pulse position vector using the position of each pulse specified by the index and outputs the vector to the first sound source generating circuit 20 and to the second pulse position generating circuit 211.

The index output by the code input circuit 220 and the first pulse position vector $P^{-}=(P_1, P_2, \ldots, P_M)$ output by the first pulse position generating circuit 210 enter the second pulse position generating circuit 211. The latter revises the first pulse position vector using the pulse position revision quantity $d^{-}_{i}(d_{i1}, d_{i2}, \ldots, d_{iM})$ specified by the index and outputs the revised vector to the second sound source generating circuit 21 as a second pulse position vector $Q^{-t}=(P_1+d_{i1}, P_2+d_{i2}, \ldots, P_M+d_{iM})$.

[Third Embodiment]

Figure 5:
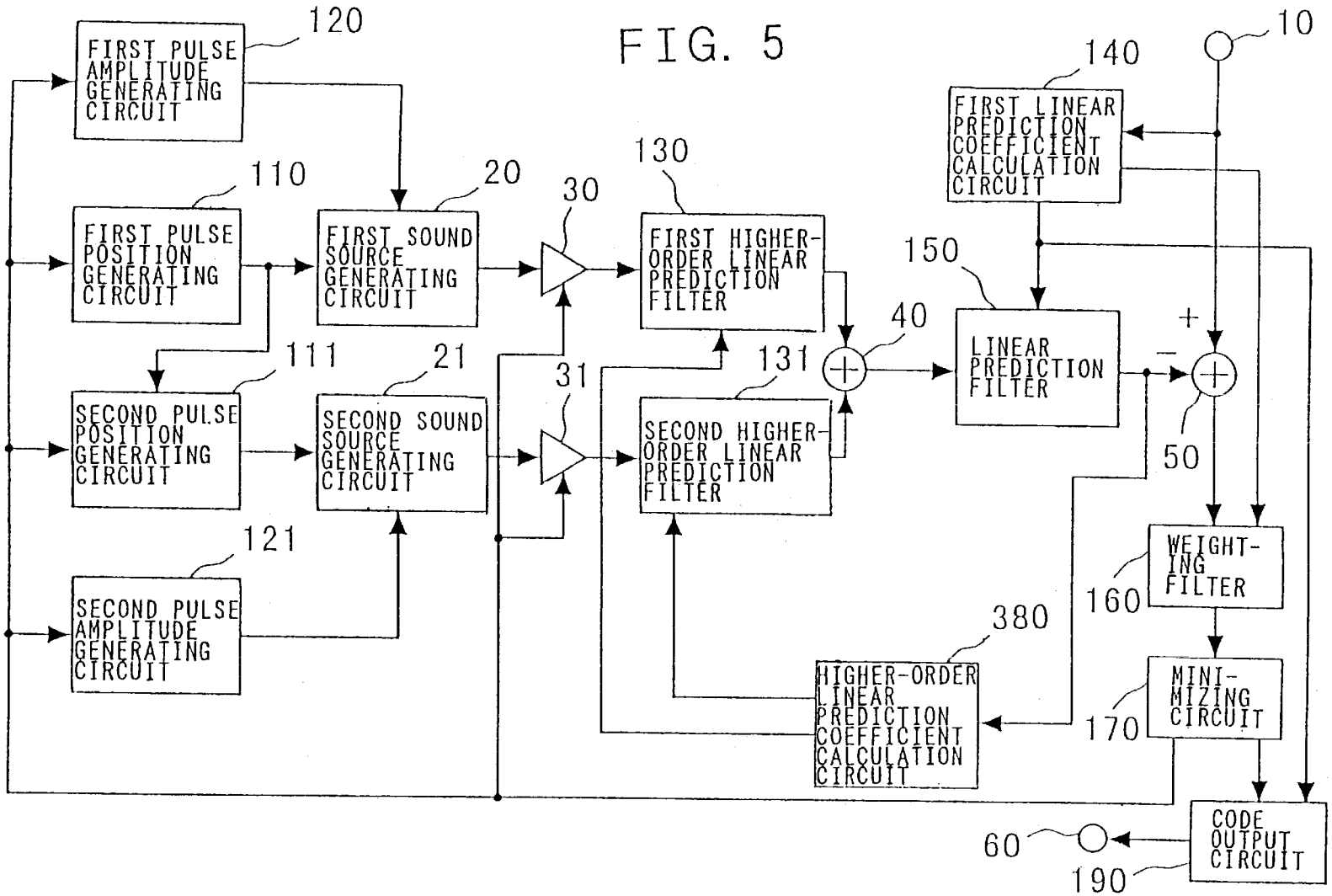
FIG. 5 is a block diagram illustrating the construction of a third embodiment of an apparatus for encoding speech and musical signals according to the present invention.

FIG. 5 is a block diagram illustrating the construction of a third embodiment of an apparatus for encoding speech and musical signals according to the present invention. As shown in FIG. 5, the apparatus for encoding speech and musical signals according to the third embodiment of the present invention has a higher-order linear prediction coefficient calculation circuit 380 substituted for the higher-order linear prediction coefficient calculation circuit 180 of the second embodiment shown in FIG. 3. Moreover, the first band-pass filter 135 and second band-pass filter 136 are eliminated.

Figure 6:
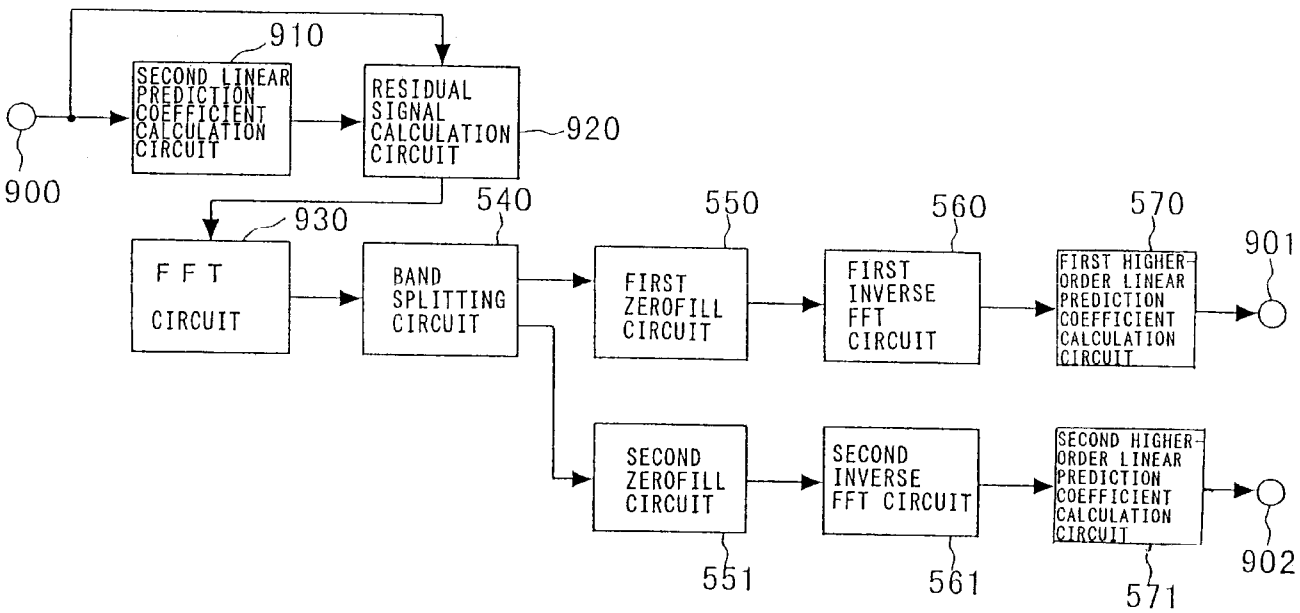
FIG. 6 is a block diagram illustrating the construction of a higher-order linear prediction coefficient calculation circuit according to the third embodiment.
Figure 11:
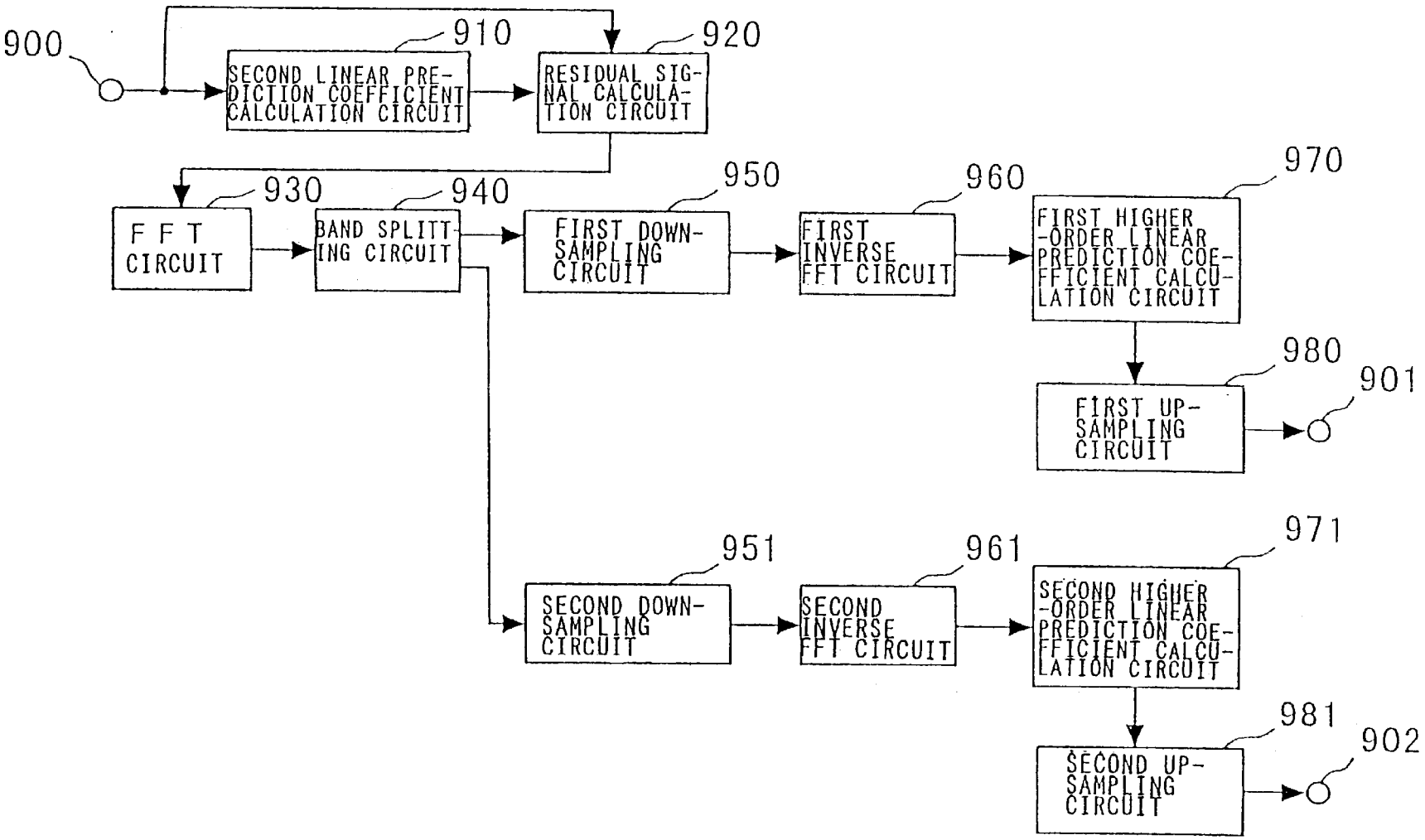
FIG. 11 PRIOR ART
FIG. 11 is a block diagram illustrating the construction of a higher-order linear prediction coefficient calculation circuit according to the prior art.

FIG. 6 is a diagram illustrating an example of the construction of the higher-order linear prediction coefficient calculation circuit 380 in the apparatus for encoding speech and musical signals according to the third embodiment depicted in FIG. 5. Components in FIG. 6 identical with or equivalent to those of FIG. 11 are designated by like reference characters and are not described again in order to avoid prolixity. Only the features that distinguish this higher-order linear prediction coefficient calculation circuit will be discussed.

Fourier coefficients output by the FFT circuit 930 enter the band splitting circuit 540. The latter equally partitions these Fourier coefficients into high- and low-frequency regions, thereby obtaining low-frequency Fourier coefficients and high-frequency(region) Fourier coefficients. The low-frequency coefficients are output to the first zerofill circuit 550 and the high-frequency coefficients are output to the second zerofill circuit 551.

The low-frequency Fourier coefficients output by the band splitting circuit 540 enter the first zerofill circuit 550, which fills the band corresponding to the high-frequency region with zeros, generates first full-band Fourier coefficients and outputs these coefficients to the first inverse FFT circuit 560.

The high-frequency Fourier coefficients output by the band splitting circuit 540 enter the second zerofill circuit 551, which fills the band corresponding to the low-frequency region with zeros, generates second full-band Fourier coefficients and outputs these coefficients to the second inverse FFT circuit 561.

The first full-band Fourier coefficients output by the first zerofill circuit 550 enter the first inverse FFT circuit 560, which proceeds to subject these coefficients to an inverse FFT, thereby obtaining a first residual signal that is output to the first higher-order linear prediction coefficient calculation circuit 570.

The second full-band Fourier coefficients output by the second zerofill circuit 551 enter the second inverse FFT circuit 561, which proceeds to subject these coefficients to an inverse FFT, thereby obtaining a second residual signal that is output to the second higher-order linear prediction coefficient calculation circuit 571.

The first residual signal output by the first inverse FFT circuit 560 enters the, first higher-order linear prediction coefficient calculation circuit 570, which proceeds to subject the first residual signal to higher-order linear prediction analysis, thereby obtaining the first higher-order linear prediction coefficient. This is output to the first higher-order linear prediction filter 130 via the output terminal 901.

The second residual signal output by the second inverse FFT circuit 561 enters the second higher-order linear prediction coefficient calculation circuit 571, which proceeds to subject the second residual signal to higher-order linear prediction analysis, thereby obtaining the second higher-order linear prediction coefficient. This is output to the second higher-order linear prediction filter 131 via the output terminal 902.

Figure 7:
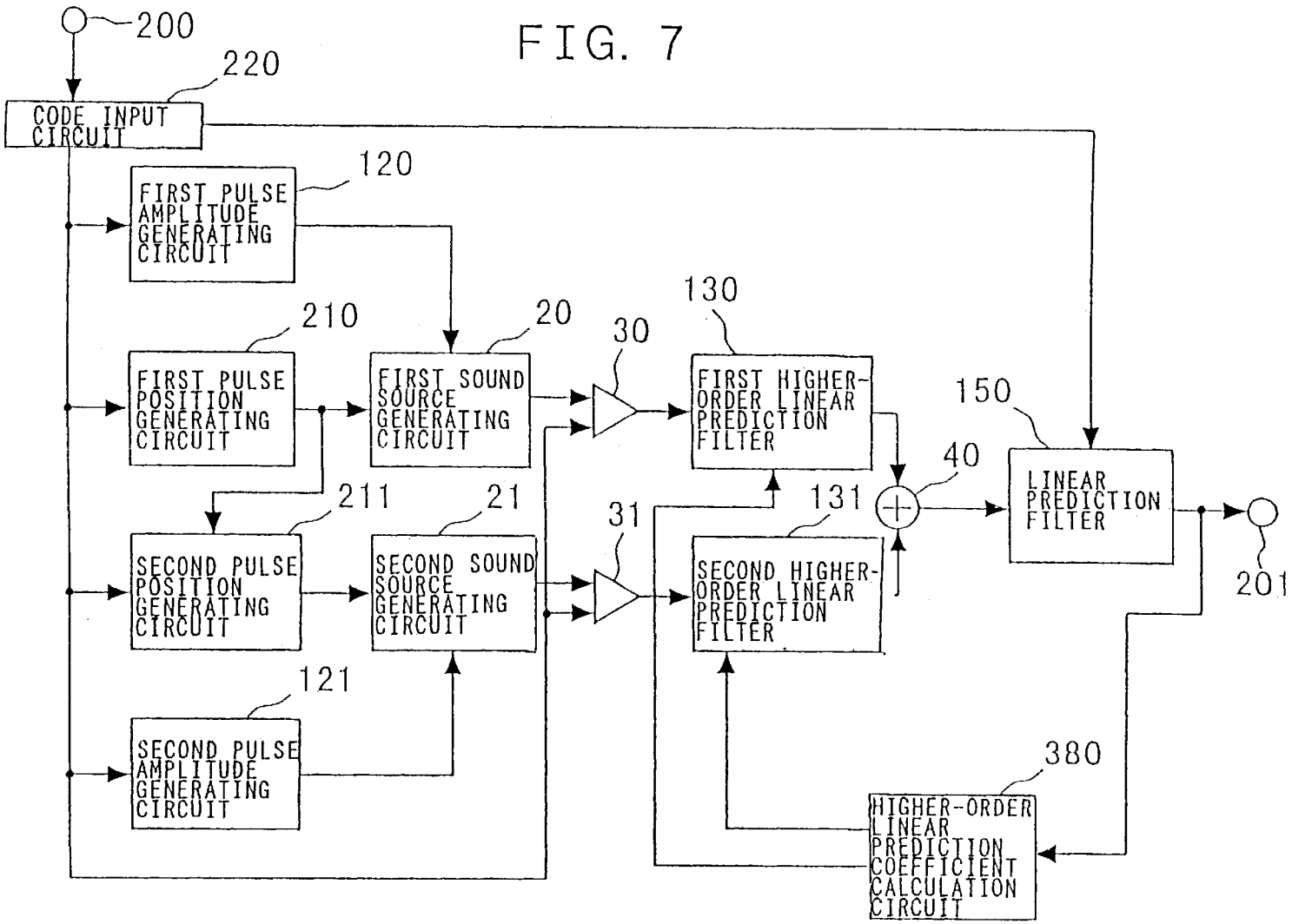
FIG. 7 is a block diagram illustrating the construction of a third embodiment of an apparatus for decoding speech and musical signals according to the present invention.

FIG. 7 is a block diagram illustrating the construction of the third embodiment of an apparatus for decoding speech and musical signals according to the present invention. As shown in FIG. 7, the apparatus for decoding speech and musical signals according to the third embodiment of the present invention has the higher-order linear prediction coefficient calculation circuit 380 substituted for the higher-order linear prediction coefficient calculation circuit 180 of the second embodiment shown in FIG. 4.

Moreover, the first band-pass filter 135 and second band-pass filter 136 are eliminated.

[Fourth Embodiment]

Figure 8:
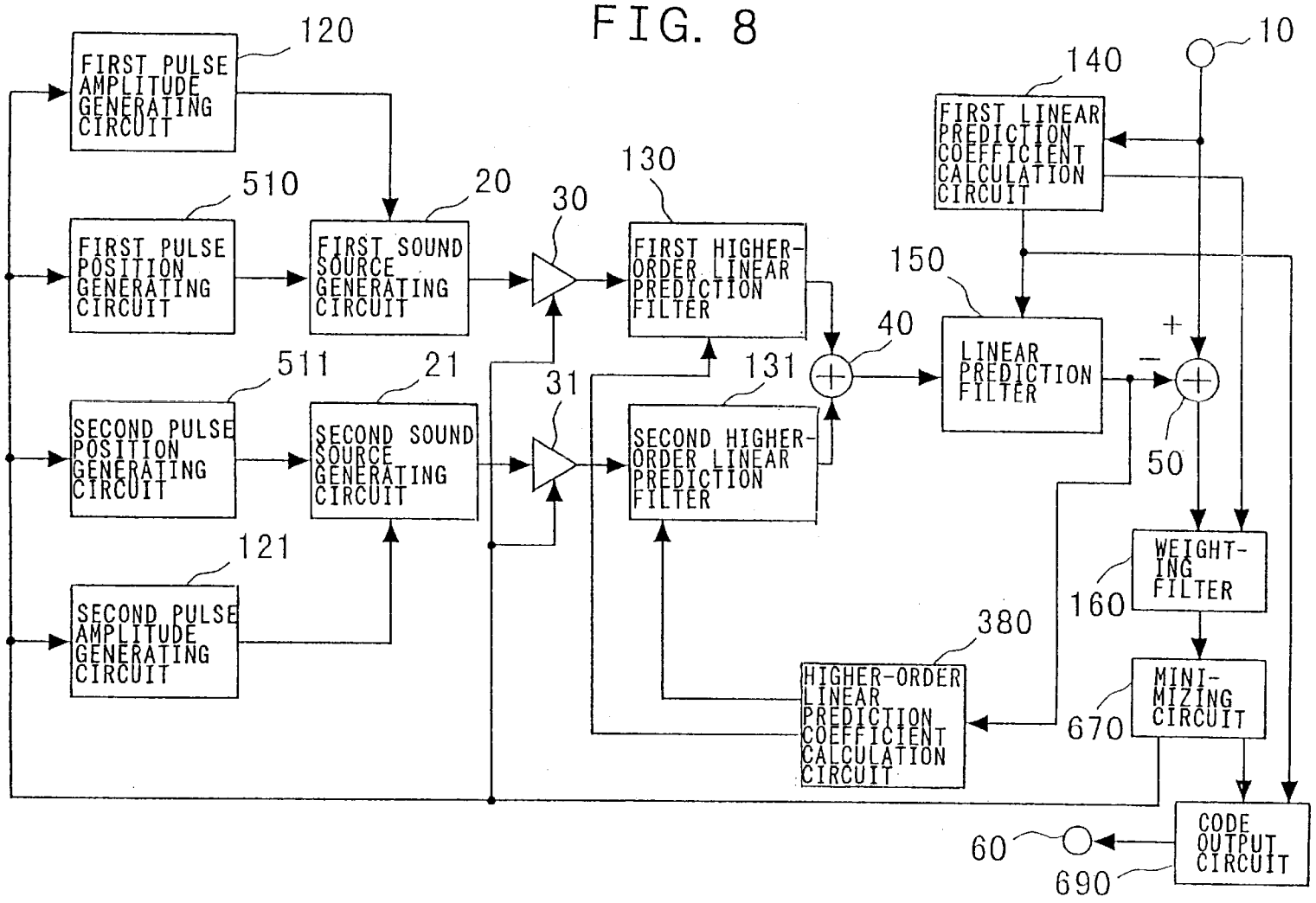
FIG. 8 is a block diagram illustrating the construction of a fourth embodiment of an apparatus for encoding speech and musical signals according to the present invention.

FIG. 8 is a block diagram illustrating the construction of a fourth embodiment of an apparatus for encoding speech and musical signals according to the present invention. As shown in FIG. 8, the apparatus for encoding speech and musical signals according to the fourth embodiment of the present invention has the higher-order linear prediction coefficient calculation circuit 380 substituted for the higher-order linear prediction coefficient calculation circuit 180 shown in FIG. 10. Moreover, the first band-pass filter 135 and second band-pass filter 136 are eliminated.

Figure 9:
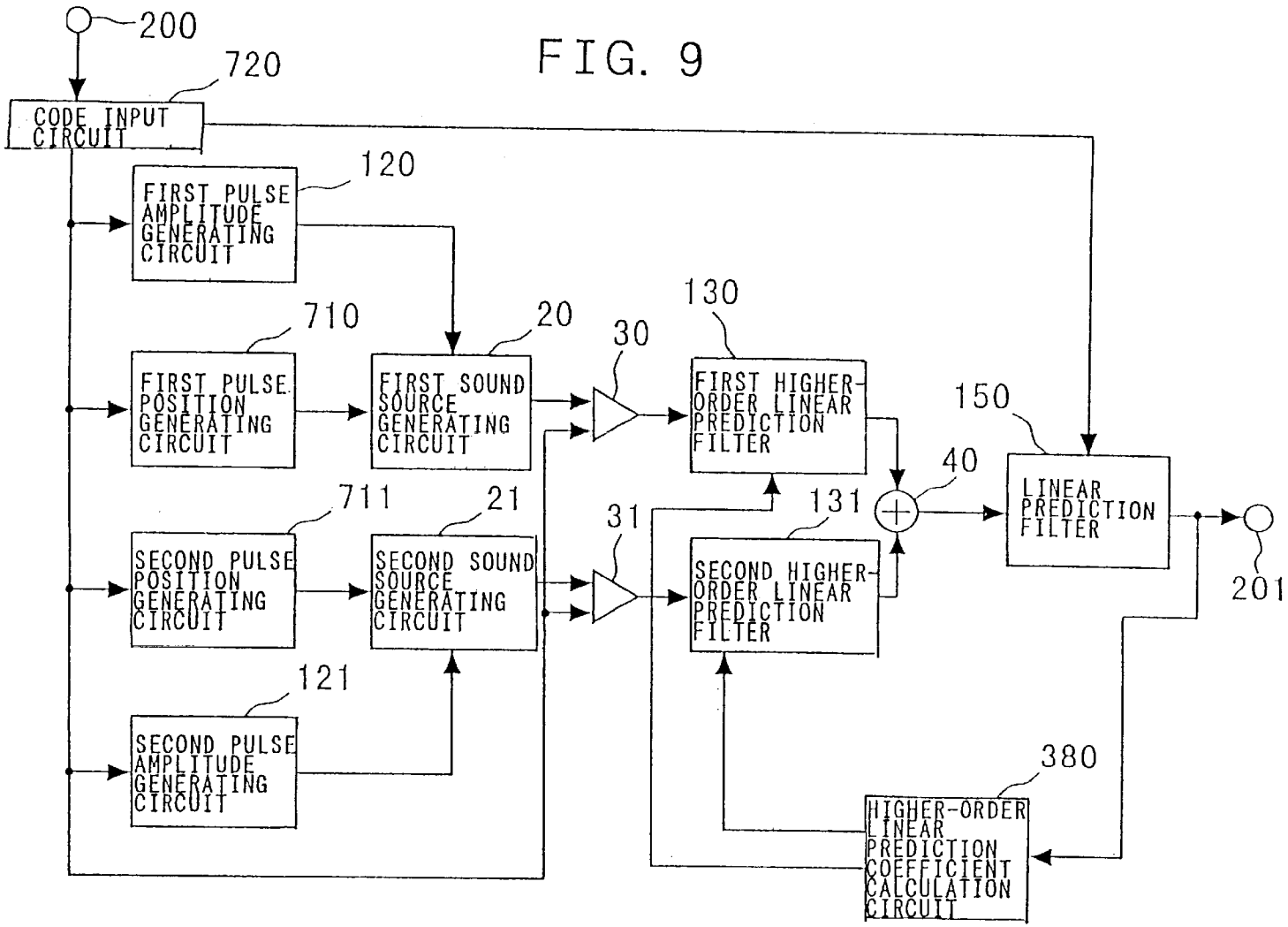
FIG. 9 is a block diagram illustrating the construction of a fourth embodiment of an apparatus for decoding speech and musical signals according to the present invention.

FIG. 9 is a block diagram illustrating the construction of the fourth embodiment of an apparatus for decoding speech and musical signals according to the present invention. As shown in FIG. 9, the apparatus for decoding speech and musical signals according to the fourth embodiment of the present invention has the higher-order linear prediction coefficient calculation circuit 380 substituted for the higher-order linear prediction coefficient calculation circuit 180 shown in FIG. 12. Moreover, the first band-pass filter 135 and second band-pass filter 136 are eliminated.

Though the number of band s is limited to two in the foregoing description for the sake of simplicity, the present invention is applicable in similar fashion to cases where the number of bands is three or more.

Further, it goes without saying that the present invention may be so adapted that the first pulse position vector is used as the second pulse position vector. Further, it is possible to use all or part of the first pulse amplitude vector as the second pulse amplitude vector.

Thus, in accordance with the present invention, as described above, the sound source signal of each of a plurality of bands can be encoded using a small number of bits in a band-splitting-type apparatus for encoding speech and musical signals. The reason for this is that the correlation between bands possessed by the input signal is taken into consideration some of the information possessed by a sound source signal that has been encoded in a certain band or bands is used to encode a sound source signal in the other band(s).

As many apparently widely different embodiments of the present invention can be made without departing from the spirit and scope thereof, it is to be understood that the invention is not limited to the specific embodiments thereof except as defined in the appended claims.

What is claimed is:

1. A speech and musical signal encoding apparatus, which, when encoding an input signal upon splitting the input signal into a plurality of bands, generates a reconstructed signal by exciting a synthesis filter by a full-band sound source signal, wherein the full-band sound source signal is obtained by summing, over all bands, signals obtained by exciting a higher-order linear prediction filter, wherein the higher-order linear prediction filter represents a fine structure of a spectrum relating to the input signal of each band, by a multipulse sound source signal corresponding to each band, wherein:

a residual signal is found by inverse filtering of the reconstructed signal using a linear prediction filter for which linear prediction coefficients obtained from the reconstructed signal have been determined; and orthogonal transform coefficients obtained by converting the residual signal are split into bands, and said higher-order linear prediction filter uses coefficients obtained from a residual signal of each band generated in each band by inverse-converting the orthogonal transform coefficients that have been split into the bands.

2. A speech and musical signal decoding apparatus for generating a reconstructed signal by exciting a synthesis filter by a full-band sound source signal, wherein the full-band sound source signal is obtained by summing, over all bands, signals obtained by exciting a higher-order linear prediction filter, wherein the higher-order linear prediction filter represents a fine structure of a spectrum relating to the input signal of each band, by a multipulse sound source signal corresponding to each band, wherein:

a residual signal is found by inverse filtering of the reconstructed signal using a linear prediction filter for which linear prediction coefficients obtained from the reconstructed signal have been determined; and orthogonal transform coefficients obtained by converting the residual signal are split into bands, and said higher-order linear prediction filter uses coefficients obtained from a residual signal of each band generated in each band by inverse-converting the orthogonal transform coefficients that have been split into the bands.

3. A speech and musical signal encoding apparatus which, when encoding an input signal upon splitting the input signal into a plurality of bands, generates a reconstructed signal by exciting a synthesis filter by a full-band sound source signal, wherein the full-band sound source signal is obtained by summing, over all bands, signals obtained by exciting a higher-order linear prediction filter, wherein the higher-order linear prediction filter represents a fine structure of a spectrum relating to the input signal of each band, by a multipulse sound source signal corresponding to each band, wherein a position obtained by shifting the position of each pulse which defines the multipulse signal in one of the bands is used when defining a multipulse signal in the other bands, wherein a residual signal is found by inverse filtering of the reconstructed signal using a linear prediction filter for which linear prediction coefficients obtained from the reconstructed signal have been determined, wherein orthogonal transform coefficients obtained by converting the residual signal are split into bands, and wherein said higher-order linear prediction filter uses coefficients obtained from a residual signal of each band generated in each band by inverse-converting the orthogonal transform coefficients that have been split into the bands.

4. A speech and musical signal decoding apparatus for generating a reconstructed signal by exciting a synthesis filter by a full-band sound source signal, wherein the full-band sound source signal is obtained by summing, over all bands, signals obtained by exciting a higher-order linear prediction filter, wherein the higher-order linear prediction filter represents a fine structure of a spectrum relating to the input signal of each band, by a multipulse sound source signal corresponding to each band, wherein a position obtained by shifting the position of each pulse which defines the multipulse signal in one of the bands is used when defining a multipulse signal in the other bands, wherein a residual signal is found by inverse filtering of the reconstructed signal using a linear prediction filter for which linear prediction coefficients obtained from the reconstructed signal have been determined, wherein orthogonal transform coefficients obtained by converting the residual signal are split into bands, and wherein said higher-order linear prediction filter uses coefficients obtained from a residual signal of each band generated in each band by inverse-converting the orthogonal transform coefficients that have been split into the bands.

5. A speech and musical signal encoding apparatus which, when encoding an input signal upon splitting the input signal into a plurality of bands, generates a reconstructed signal using la multipulse sound source signal that corresponds to each band, comprising:

(a) first pulse position generating means, to which an index output by minimizing means is input, for generating a first pulse position vector using the position of each pulse specified by the index and outputting the first pulse position vector to a corresponding sound source generating means and to one or a plurality of other pulse position generating means; and (b) one or a plurality of pulse position generating means, to which the index output by said minimizing means and the first pulse position, vector output by said first pulse position generating means are input, for generating a pulse position vector by revising the first pulse position vector using a pulse position revision quantity specified by the index, and outputting this revised pulse position vector to corresponding sound source generating means.

6. A speech and musical signal decoding apparatus for generating a reconstructed signal using a multi pulse sound source signal corresponding to each of a plurality of bands, comprising:

(a) first pulse position generating means, to which an index output by code input means is input, for generating a first pulse position vector using the position of each pulse specified by the index and outputting the first pulse position vector to a corresponding sound source generating means and to one or a plurality of other pulse position generating means; and (b) one or a plurality of pulse position generating means, to which the index output by said code input means and the first pulse position vector output by said first pulse position generating means are input, for generating a pulse position vector by revising the first pulse position vector using a pulse position revision quantity specified by the index, and out putting this pulse position vector to corresponding sound source generating means.

7. A speech and music encoding apparatus comprising:

(a) first pulse position generating means, to which an index output by minimizing means is input, for generating a first pulse position vector using the position of each pulse specified by the index and outputting the first pulse position vector to first sound source generating means and to second pulse position generating means;

(b) second pulse position generating means, to which the index output by said minimizing means and the first pulse position vector output by said first pulse position generating means are input, for revising the first pulse position vector using a pulse position revision quantity specified by the index, and outputting this revised pulse position vector to second sound source generating means as a second pulse position vector;

(c) first and second pulse amplitude generating means, to which the index output by said minimizing means is input, for outputting first and second pulse amplitude vectors to said first and second sound source generating means, respectively, from said index;

(d) said first and second sound source generating means, to which the first and second pulse position vectors output by said first and second pulse position generating means and the first and second pulse amplitude vectors output by said first and second pulse amplitude generating means are respectively input, for generating first and second sound source vectors and outputting the first and second sound source vectors to first and second gain means, respectively;

(e) first and second gain means, each of which has a table in which gain values have been stored and to which the index output by said minimizing means and the first and second sound source vectors, respectively, output by said first and second sound source generating are input, for reading first and second gains corresponding to the index out of the tables, multiplying the first and second gains by the first and second sound source vectors, respectively, and outputting the products as third and fourth sound source vectors, respectively;

(f) first and second band-pass filters for band-passing the third and fourth sound source vectors from said first and second gain means and outputting them as fifth and sixth sound source vectors, respectively;

(g) adding means for adding the fifth and sixth sound source vectors output thereto from said first and second band-pass filters, respectively, and outputting an excitation vector, which is the sum of the fifth and sixth sound source vectors, to a linear prediction filter;

(h) a linear prediction filter, which has a table in which quantized values of linear prediction coefficients have been stored and to which the excitation vector output by said adding means and an index corresponding to a quantized value of a linear prediction coefficient output by first linear prediction coefficient calculation means are input, for reading a quantized value of a linear prediction coefficient corresponding to said index out of the table and driving a filter, for which this quantized linear prediction coefficient has been set, by the excitation vector, thereby obtaining a reconstructed vector, said reconstructed vector being output to subtraction means;

(i) first linear prediction coefficient calculation means for obtaining a linear prediction coefficient by applying linear prediction analysis to an input vector from an input terminal, quantizing this linear prediction coefficient, outputting this linear prediction coefficient to a weighting filter and outputting an index, which corresponds to the quantized value of this linear prediction coefficient, to a linear prediction filter and to code output means;

(j) subtraction means, to which an input vector is input via the input terminal and to which the reconstructed vector output by said linear prediction filter is input, for outputting a difference vector, which is the difference between the input vector and the reconstructed vector, to the weighting filter;

(k) said weighting filter, to which the difference vector output by said difference means and the linear prediction coefficient output by said first linear prediction calculating means are input, for generating a weighting filter corresponding to the characteristic of the human sense of hearing using this linear prediction coefficient and driving said weighting filter by the difference vector, thereby obtaining a weighted difference vector, said weighted difference vector being output to said minimizing means;

(l) minimizing means, to which weighted difference vectors output by said weighting filter are successively input, for calculating norms of these vectors; successively outputting, to said first pulse position generating means, indices corresponding to all values of the elements in the first pulse position vector; successively outputting, to said second pulse position generating means, indices corresponding to all pulse position revision quantities; successively outputting, to said first pulse amplitude generating means, indices corresponding to all first pulse amplitude vectors; successively outputting, to said second pulse amplitude generating means, indices corresponding to all second pulse amplitude vectors; successively outputting, to said first gain means, indices corresponding to all first gains; successively outputting, to said second gain means, indices corresponding to all second gains; selecting, so as to minimize the norms, the value of each element in the first pulse position vector, the pulse position revision quantity, the first pulse amplitude vector, the second pulse amplitude vector and the first gain and second gain; and outputting indices corresponding to these to said code output means; and (m) code output means, to which the index corresponding to the quantized value of the linear prediction coefficient output by said first linear prediction coefficient calculation means is input as well as the indices, which are output by said minimizing means, corresponding to the value of each element in the first pulse position vector, the pulse position revision quantity, the first pulse amplitude vector, the second pulse amplitude vector and the first gain and second gain, respectively, for converting each index to a bit-sequence code and outputting the bit-sequence code from an output terminal.

8. The apparatus according to claim 7, further comprising first and second higher-order linear prediction filters to which the third and fourth sound source vectors respectively generated by said first and second gain means are input, respectively;

wherein third and fourth higher-order linear prediction coefficients output from higher-order linear prediction coefficient calculating means whose input is the output of said linear prediction filter, as well as the third and fourth sound source vectors respectively output by said first and second gains means, are respectively input to said first and second higher-order linear prediction filters, said first and second higher-order linear prediction filters driving filters, for which the third and fourth higher-order linear prediction coefficients have been set, by the third and fourth sound source vectors, respectively, thereby to obtain first and second excitation vectors that are output to said first and second band pass filters, respectively.

9. The apparatus according to claim 7, wherein said first and second band-pass filters are deleted, and outputs of said first and second higher-order linear prediction-filters are input to said adding means.

10. The apparatus according to claim 7, further comprising:

second linear prediction coefficient calculation means, to which the reconstructed vector output by said linear prediction filter is input, for applying linear prediction analysis to the reconstructed vector and obtaining a second linear prediction coefficient;

residual signal calculation means, to which the second linear prediction coefficient output by said second linear prediction coefficient calculation means and the reconstructed vector output by said linear prediction filter are input, for outputting a residual vector by subjecting the reconstructed vector to inverse filtering processing using a filter for which the second linear prediction coefficient has been set;

FFT means, to which the residual vector from said residual signal calculation means is input, for subjecting the residual vector to a fast-Fourier transform;

band splitting means, to which Fourier coefficients output by said FFT means are input, for equally partitioning these Fourier coefficients into low- and high-frequency regions to obtain low-frequency Fourier coefficients and high-frequency Fourier coefficients, and for outputting these low-frequency Fourier coefficients and high-frequency Fourier coefficients;

first zerofill means, to which the low-frequency Fourier coefficients output by said band splitting means are input, for filling the band corresponding to the high-frequency region with zeros to thereby generate and output first full-band Fourier coefficients;

second zerofill means, to which the high-frequency Fourier coefficients output by said band splitting means are input, for filling the, band corresponding to the low-frequency region with zeros to thereby generate and output second full-band Fourier coefficients;

first inverse FFT means, to which the first full-band Fourier coefficients output by said first zerofill means are input, for subjecting these coefficients to an inverse fast-Fourier transform and outputting a first residual signal thus obtained;

second inverse FFT means, to which the second full-band Fourier coefficients output by said second zerofill means are input, for subjecting these coefficients to an inverse fast-Fourier transform and outputting a second residual signal thus obtained;

first higher-order linear prediction coefficient calculation means, to which the first residual signal is input, for applying higher-order linear prediction analysis to the first residual signal to obtain a first higher-order linear prediction coefficient, and outputting this coefficient to said first higher-order linear prediction filter; and second higher-order linear prediction coefficient calculation means, to which the second residual signal is input, for applying higher-order linear prediction analysis to the second residual signal to obtain a second higher-order linear prediction coefficient, and outputting this coefficient to said second higher-order linear prediction filter.

11. A speech and music decoding apparatus comprising:

(a) code input means for converting a bit-sequence code, which has entered from an input terminal, to an index;

(b) first pulse position generating means, to which an index output by said code input means is input, for generating a first pulse position vector using the position of each pulse specified by the index and outputting the first pulse position vector to first sound source generating means and to second pulse position generating means;

(c) second pulse position generating means, to which the index output by said code input means and the first pulse position vector output by said first pulse position generating means are input, for revising the first pulse position vector using a pulse position revision quantity specified by the index, and outputting this revised pulse position vector to second sound source generating means as a second pulse position vector;

(d) first and second pulse amplitude generating means, to which the index output by said code input means is input, for reading out vectors corresponding to this index and outputting these vectors to first and second pulse amplitude generating means as first and second amplitude vectors, respectively;

(e) first and second sound source generating means, to which the first and second pulse position vectors output by said first and second pulse position generating means and the first and second pulse amplitude vectors output by said first and second pulse amplitude generating means are respectively input, for generating first and second sound source vectors and outputting the first and second sound source vectors to first and second gain means, respectively;

(f) first and second gain means, each of which has a table in which gain values have been stored and to which the index output by said code input means and the first and second sound source vectors, respectively, output by said first and second sound source generating are input, for reading first and second gains corresponding to the index out of the tables, multi plying the first and second gains by the first and second sound source vectors, respectively, to thereby generate third and fourth sound source vectors, and outputting the generated third and fourth sound source vectors to first and second band-pass filters, respectively;

(g) adding means for adding the fifth and sixth sound source vectors output thereto from said first and second band-pass filters, respectively, and outputting an excitation vector, which is the sum of the fifth and sixth sound source vectors, to a linear prediction filter; and (h) a linear prediction filter, which has a table in which quantized values of linear prediction coefficients have been stored and to which the excitation vector output by said adding means and an index corresponding to a quantized value of a linear prediction coefficient output by first linear prediction coefficient calculation means are input, for reading a quantized value of a linear prediction coefficient corresponding to said index out of the table and driving a filter, for which this quantized linear prediction coefficient has been set, by the excitation vector, thereby obtaining a reconstructed vector, said reconstructed vector being output from an output terminal.

12. The apparatus according to claim 11, further comprising first and second higher-order linear prediction filters to which the third and fourth sound source vectors respectively generated by said first and second gain means are input, respectively;

wherein third and fourth higher-order linear prediction coefficients output from higher-order linear prediction coefficient calculating means whose input is the output of said linear prediction filter, as well as the third and fourth sound source vectors respectively output by said first and second gains means, are respectively input to said first and second higher-order linear prediction filters, said first and second higher-order linear prediction filters driving filters, for which the third and fourth higher-order linear prediction coefficients have been set, by the third and fourth sound source vectors, respectively, thereby to obtain first and second excitation vectors that are output to said first and second band-pass filters, respectively.

13. The apparatus according to claim 11, wherein said first and second band-pass filters are deleted, and outputs of said first and second higher-order linear prediction filters are input to said adding means.

14. The apparatus according to claim 11, further comprising:

second linear prediction coefficient calculation means, to which the reconstructed vector output by said linear prediction filter is input, for applying linear prediction analysis to the reconstructed vector and obtaining a second linear prediction coefficient;

residual signal calculation means, to which the second linear prediction coefficient output by said second linear prediction coefficient calculation means and the reconstructed vector output by said linear prediction filter are input, for outputting a residual vector by subjecting the reconstructed vector to inverse filtering processing using a filter for which the second linear prediction coefficient has been set;

FFT means, to which the residual vector from said residual signal calculation means is input, for subjecting the residual vector to a fast-Fourier transform;

band splitting means, to which Fourier coefficients output by said FFT means are input, for equally partitioning these Fourier coefficients into low- and high-frequency regions to obtain low-frequency Fourier coefficients and high-frequency Fourier coefficients, and for outputting these low-frequency Fourier coefficients and high-frequency Fourier coefficients;

first zerofill means, to which the low-frequency Fourier coefficients output by said band splitting means are input, for filling the band corresponding to the high-frequency region with zeros to thereby generate and output first full-band Fourier coefficients;

second zerofill means, to which the high-frequency Fourier coefficients output by said band splitting means are input, for filling the band corresponding to the low-frequency region with zeros to thereby generate and output second full-band Fourier coefficients;

first inverse FFT means, to which the first full-band Fourier coefficients output by said first zerofill means are input, for subjecting these coefficients to an inverse fast-Fourier transform and outputting a first residual signal thus obtained;

second inverse FFT means, to which the second full-band Fourier coefficients output by said second zerofill means are input, for subjecting these coefficients to an inverse fast-Fourier transform and outputting a second residual signal thus obtained;

first higher-order linear prediction coefficient calculation means, to which the first residual signal is input, for applying higher-order linear prediction analysis to the first residual signal to obtain a first higher-order linear prediction coefficient, and outputting this coefficient to said first higher-order linear prediction filter; and second higher-order linear prediction coefficient calculation means, to which the second residual signal is input, for applying higher-order linear prediction analysis to the second residual signal to obtain a second higher-order linear prediction coefficient, and outputting this coefficient to said second higher-order linear prediction filter.

15. A speech and musical signal encoding apparatus, comprising:

an input terminal for receiving an input vector as an input sound signal;

a linear prediction coefficient calculation circuit that receives the input vector from the input terminal, that subjects the input vector to linear prediction analysis to obtain a linear prediction coefficient, and that quantizes the linear prediction coefficient to obtain an index;

a weighting filter that receives a difference vector on a first input port, the linear prediction coefficient output by the first linear prediction coefficient calculation circuit on a second input port, the weighting filter weighting the difference vector based on the linear prediction coefficient, the weighting filter outputting a weighted difference vector as a result;

a linear prediction filter that receives the index output by the linear prediction coefficient calculation circuit on a first input port and that receives a high-order-filtered sound signal on a second input port, and that outputs a linear-prediction-filtered sound signal based on the index;

a subtractor that subtracts the linear-prediction-filtered sound signal from the input vector, and that provides a subtracted signal as the difference vector to the weighting filter;

first and second higher-order linear prediction filters that respectively receive first and second sound source vectors at input ports thereof, the first and second higher-order linear prediction filters outputting first and second sound source filtered signals based on first and second higher-order prediction coefficients respectively provided thereto;

a higher-order linear prediction coefficient calculation circuit that receives the linear-predicted-filtered sound signal output by the linear prediction filter, and that outputs the first and second higher-order prediction coefficients to the first and second higher-order linear prediction filters, respectively; and a code output circuit that outputs a bit-sequence code as an output sound signal based on the weighted difference vector output by the weighting filter and the index output by the first linear prediction coefficient calculation circuit.

16. The apparatus according to claim 15, wherein the higher-order linear prediction coefficient calculation circuit comprises:

an FFT circuit for providing fourier coefficients of an signal input thereto;

a band splitting circuit that partitions the fourier coefficients into at least a first frequency band and a second frequency band;

a first zerofill circuit that fills the first frequency band with zeros, and that generates first full-band Fourier coefficients;

a second zerofill circuit that fills the second frequency band with zeros, and that generates second full-band Fourier coefficients;

a first inverse FFT circuit that performs an inverse FFT operation on the first full-band Fourier coefficients, to provide a first residual signal as a result;

a second inverse FFT circuit that performs an inverse FFT operation on the second full-band Fourier coefficients, to provide a second residual signal as a result;

a first higher-order linear prediction coefficient calculation circuit that performs a higher-order linear prediction analysis on the first residual signal, to thereby provide a first higher-order linear prediction coefficient as a result; and a second higher-order linear prediction coefficient calculation circuit that performs a higher-order linear prediction analysis on the second residual signal, to thereby provide a second higher-order linear prediction coefficient as a result.

* * * * *